US009302880B2

(12) United States Patent
Awano

(10) Patent No.: US 9,302,880 B2
(45) Date of Patent: Apr. 5, 2016

(54) SHEET FOLDING DEVICE, POST-PROCESSING DEVICE, AND IMAGE FORMING SYSTEM

(71) Applicant: FUJI XEROX CO., LTD., Tokyo (JP)

(72) Inventor: Hiroaki Awano, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/337,831

(22) Filed: Jul. 22, 2014

(65) Prior Publication Data

US 2015/0183612 A1 Jul. 2, 2015

(30) Foreign Application Priority Data

Dec. 27, 2013 (JP) ..... 2013-273448

(51) Int. Cl.

| | |
|---|---|
| ***B65H 45/16*** | (2006.01) |
| ***B65H 45/14*** | (2006.01) |
| ***B65H 27/00*** | (2006.01) |
| ***B65H 5/06*** | (2006.01) |
| ***B65H 45/18*** | (2006.01) |

(52) U.S. Cl.

CPC ..... *B65H 45/16* (2013.01); *B65H 5/062* (2013.01); *B65H 27/00* (2013.01); *B65H 45/147* (2013.01); *B65H 45/18* (2013.01); *B65H 2404/11* (2013.01); *B65H 2404/13* (2013.01); *B65H 2404/1311* (2013.01); *B65H 2404/1316* (2013.01); *B65H 2404/141* (2013.01); *B65H 2801/27* (2013.01)

(58) Field of Classification Search

CPC .... B65H 45/16; B65H 45/147; B65H 29/125; B65H 27/00; B65H 5/062; B65H 2801/27; B65H 2404/141; B65H 2404/1316; B65H 2404/1311

USPC ..... 270/32; 493/415, 435, 442, 445; 271/272

See application file for complete search history.

(56) References Cited

U.S. PATENT DOCUMENTS

| | | | | |
|---|---|---|---|---|
| 5,876,027 | A * | 3/1999 | Fukui et al. | 270/51 |
| 6,004,254 | A * | 12/1999 | Murata | 493/444 |
| 8,532,560 | B2 * | 9/2013 | Mizuno et al. | 399/406 |
| 8,540,241 | B2 * | 9/2013 | Sugahara | 271/265.01 |

FOREIGN PATENT DOCUMENTS

| | | | |
|---|---|---|---|
| JP | S47-38312 | A | 12/1972 |
| JP | H09-2735 | A | 1/1997 |
| JP | H10-194587 | A | 7/1998 |
| JP | 2001-335234 | A | 12/2001 |
| JP | A-2007-45531 | | 2/2007 |

OTHER PUBLICATIONS

Aug. 26, 2014 Office Action issued in Japanese Application No. 2013-273448.

* cited by examiner

*Primary Examiner* — Leslie A Nicholson, III
(74) *Attorney, Agent, or Firm* — Oliff PLC

(57) ABSTRACT

Provided is a sheet folding device including a folding roll that has a convex portion spirally provided on an outer periphery surface and is rotatably provided, and performs a folding process while pressing the convex portion on a sheet, and a phase change unit that makes a phase of the folding roll when the sheet on which the folding process is performed by the folding roll passes through the folding roll again different from a phase when the sheet passes through the folding roll for the last time.

7 Claims, 18 Drawing Sheets

SHEET FOLDING DEVICE, POST-PROCESSING DEVICE, AND IMAGE FORMING SYSTEM

CROSS-REFERENCE TO RELATED APPLICATIONS

This application is based on and claims priority under 35 USC 119 from Japanese Patent Application No. 2013-273448 filed Dec. 27, 2013.

BACKGROUND

Technical Field

The present invention relates to a sheet folding device, a post-processing device, and an image forming system.

SUMMARY

According to an aspect of the invention, there is provided a sheet folding device including:

a folding roll that has a convex portion spirally provided on an outer periphery surface and is rotatably provided, and performs a folding process while pressing the convex portion on a sheet; and a phase change unit that makes a phase of the folding roll when the sheet on which the folding process is performed by the folding roll passes through the folding roll again different from a phase when the sheet passes through the folding roll for the last time.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the invention will be described with reference to the accompanying drawings.

Description of Image Forming System 100

Figure 1:
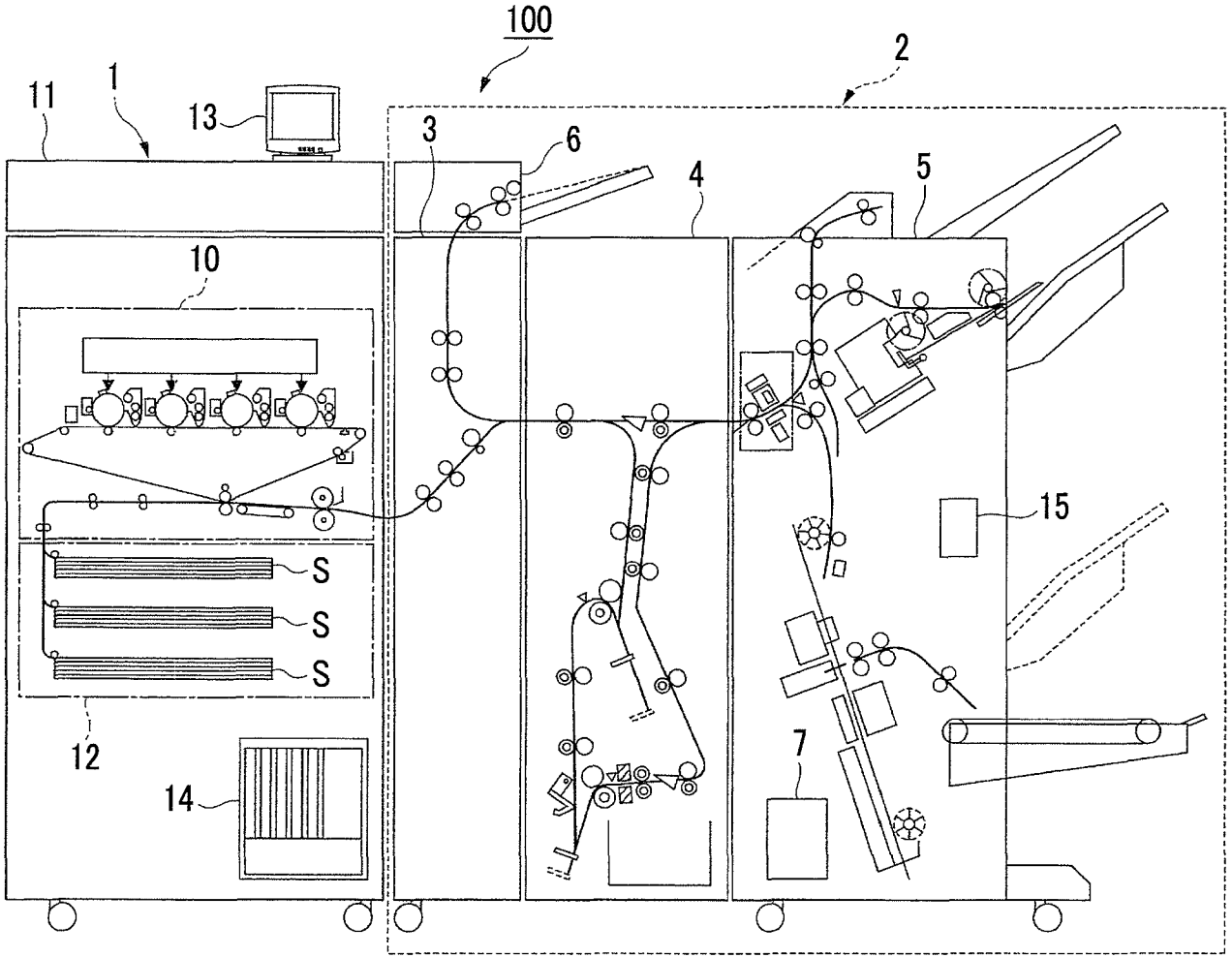
FIG. 1 is a view illustrating an entire configuration of an image forming system to which an exemplary embodiment is applied.

FIG. 1 is a view illustrating an entire configuration of an image forming system 100 to which an exemplary embodiment is applied. For example, the image forming system 100 illustrated in FIG. 1 includes an image forming apparatus 1 such as a printer or a copying machine that forms a color image by an electrophotographic system, and a post-processing device 2 that performs post-processing with respect to a recording material (sheet) S on which an image is formed by the image forming apparatus 1.

The image forming apparatus 1 includes an image forming portion 10 that forms the image based on each piece of color image data, an image reading portion 11 that reads the image from a document and generates reading image data, a sheet supply portion 12 that supplies the sheet S to the image forming portion 10, a general user interface 13 that notifies a user of an abnormality in the image forming system 100 in conjunction with receiving an operation input from a user, and a main control portion 14 that controls an entire operation of the image forming system 100.

The post-processing device 2 includes a transport unit 3 that receives and transports the sheet S on which the image is formed from the image forming apparatus 1, a folding unit 4 that performs a folding process with respect to the sheet S carried in from the transport unit 3, a finisher unit 5 that performs a final process with respect to the sheet S that is passed through the folding unit 4, and an interposer 6 that supplies a jointed paper for configuring a cover and the like of a booklet. Furthermore, the post-processing device 2 includes a sheet processing control portion 7 that controls each function portion of the post-processing device 2 and a user interface (UI) 15 that receives the operation input from the user regarding the post-processing.

Moreover, the post-processing device 2 of FIG. 1 is illustrated as a configuration in which the sheet processing control portion 7 is provided inside the post-processing device 2, however the sheet processing control portion 7 may be provided inside the image forming apparatus 1. Furthermore, the main control portion 14 may be configured to have a control function of the sheet processing control portion 7.

Furthermore, the post-processing device 2 of FIG. 1 is illustrated as a configuration in which the user interface 15 is provided inside the post-processing device 2, however the user interface 15 may be provided inside the image forming apparatus 1. Furthermore, the general user interface 13 of the image forming apparatus 1 may be configured to have a control function of the user interface 15.

Description of the Post-Processing Device 2

Figure 2:
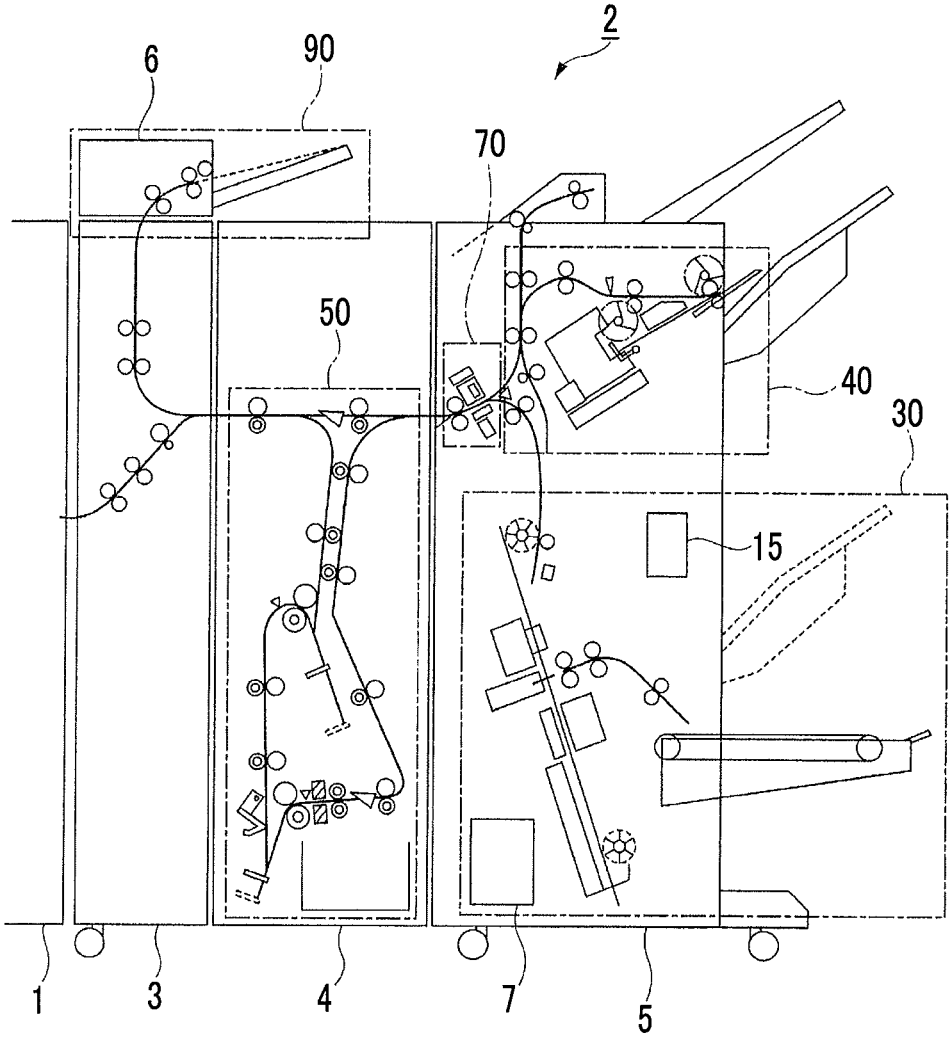
FIG. 2 is a view illustrating a function of a post-processing device.

FIG. 2 is a view illustrating a function of the post-processing device 2. The post-processing device 2 includes a punch function portion 70 that performs drilling (punching) two holes, four holes, and the like with respect to the sheet S (see FIG. 1) in the finisher unit 5, an end stitching function portion 40 that generates a sheet bundle B (see FIG. 4) only by integrating the required number of the sheets S and performs staple stitching (end stitching) in an end portion of the sheet bundle B, and a saddle stitching bookbinding function portion 30 that generates the sheet bundle B by integrating the required number of the sheets and performs a stitching process (saddle stitching process) in the center portion of the sheet bundle B and binds a booklet. Furthermore, the folding unit 4 includes a folding function portion 50 that performs inward three-folding (C folding), outward three-folding (Z folding), or the like with respect to the sheet S. Furthermore, the interposer 6 and the transport unit 3 includes a jointed paper supply function portion 90 that supplies the jointed paper such as cardboard or a window-space sheet that is used as a cover of the sheet bundle B.

Description of Saddle Stitching Bookbinding Function Portion 30

Next, the saddle stitching bookbinding function portion 30 provided in the finisher unit 5 will be described.

Figure 3:
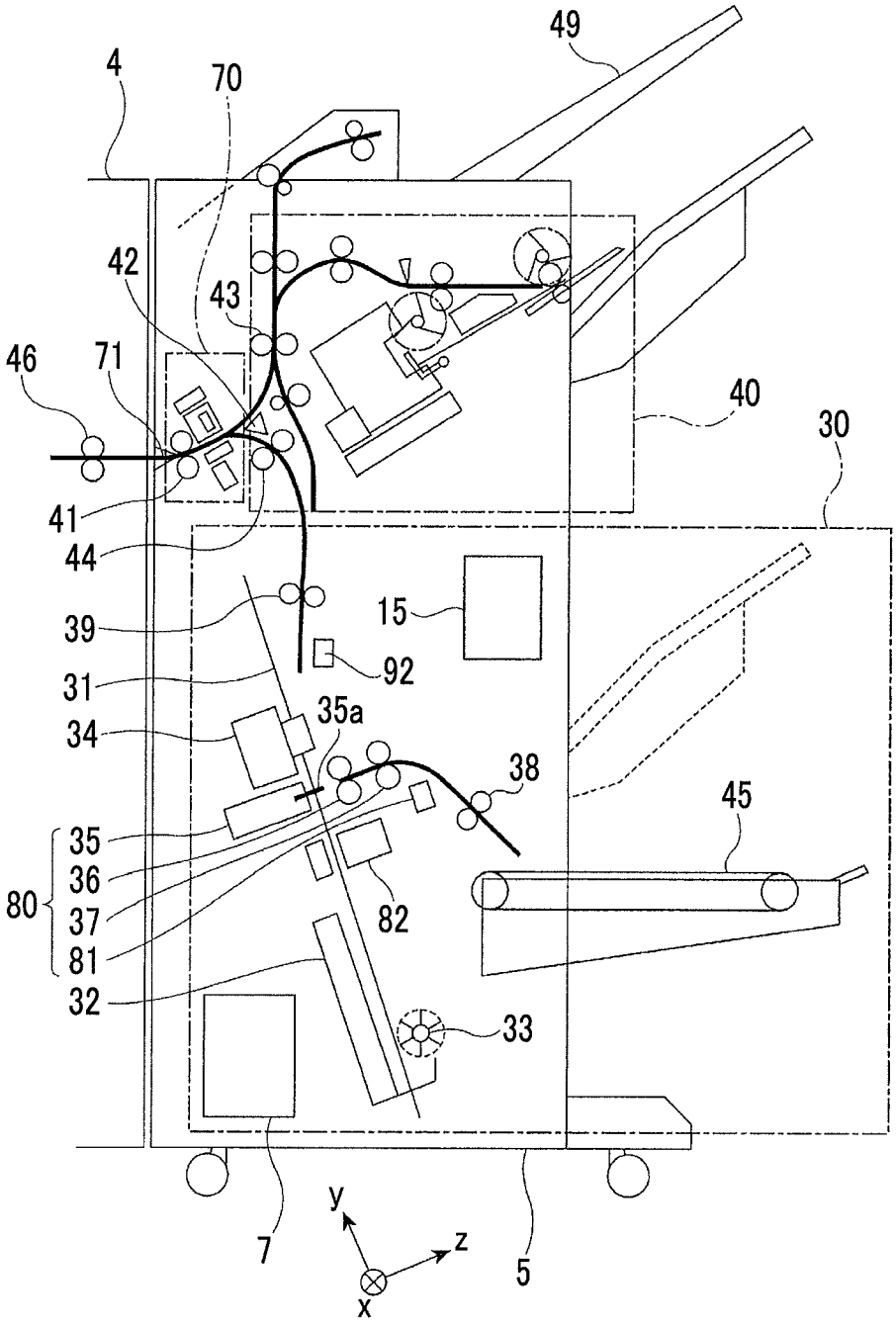
FIG. 3 is a view illustrating a configuration of a saddle stitching bookbinding function portion of the exemplary embodiment.

FIG. 3 is a view illustrating a configuration of the saddle stitching bookbinding function portion 30 of the exemplary embodiment.

As illustrated in FIG. 3, the saddle stitching bookbinding function portion 30 includes a compile tray 31 that integrates the sheet S after the image is formed only by a predetermined number of sheets and forms the sheet bundle B (see FIG. 4), a carry-in roll 39 that carries the sheet S into the compile tray 31 one by one, and an end guide 32 that stacks the sheet bundle B and determines a saddle stitching position and a folding position of the sheet bundle B. Furthermore, the saddle stitching bookbinding function portion 30 includes a sheet alignment paddle 33 that aligns the sheet S (see FIG. 1) integrated in the compile tray 31 toward the end guide 32 and a sheet width alignment member 34 that aligns the sheet S integrated in the compile tray 31 in a width direction.

Furthermore, the saddle stitching bookbinding function portion 30 includes a stapler 82 that performs binding of the sheet bundle B integrated in the compile tray 31 while penetrating staples (not illustrated). Furthermore, the saddle stitching bookbinding function portion 30 includes a folding knife 35 having a knife body 35*a* that moves so as to protrude from a rear surface side of the compile tray 31 toward a storage surface side (z direction) with respect to the sheet bundle B on which a binding process is performed. Furthermore, the saddle stitching bookbinding function portion 30 includes in order a first folding roll 36 and a second folding roll 37 that perform the folding process in the sheet bundle B in which the folding is started by the folding knife 35 in the sheet transporting direction. Furthermore, a discharge roll 38 that discharges the sheet bundle B that is subjected to the folding process and is bound and a booklet stack tray 45 that stacks the sheet bundle B that is bound are provided on a downstream side of the second folding roll 37. Furthermore, the saddle stitching bookbinding function portion 30 includes a drive portion 81 that transmits a driving force to the folding knife 35, the first folding roll 36, and the second folding roll 37, and a passage sensor 92 that detects passage of the sheet S that is carried into the compile tray 31 by the carry-in roll 39.

Moreover, in the following description, the folding knife 35, the first folding roll 36, the second folding roll 37, and the drive portion 81 are described as a folding mechanism 80.

Furthermore, in FIG. 3, a direction in which the sheet S in the storage surface of the compile tray 31 is carried is referred to as a y direction, a direction (a width direction of the sheet S) orthogonal to the direction in which the sheet S in the storage surface is carried is referred to as an x direction, and a direction orthogonal to the storage surface of the compile tray 31 is referred to as a z direction. Also, this is the same as in the views illustrated below. Furthermore, in the following description, the z direction is simply referred to a transporting direction of the sheet and the x direction is simply referred to as an intersecting direction in some cases.

Configuration of Folding Mechanism 80

Next, a configuration of the folding mechanism 80 will be described.

Figure 4:
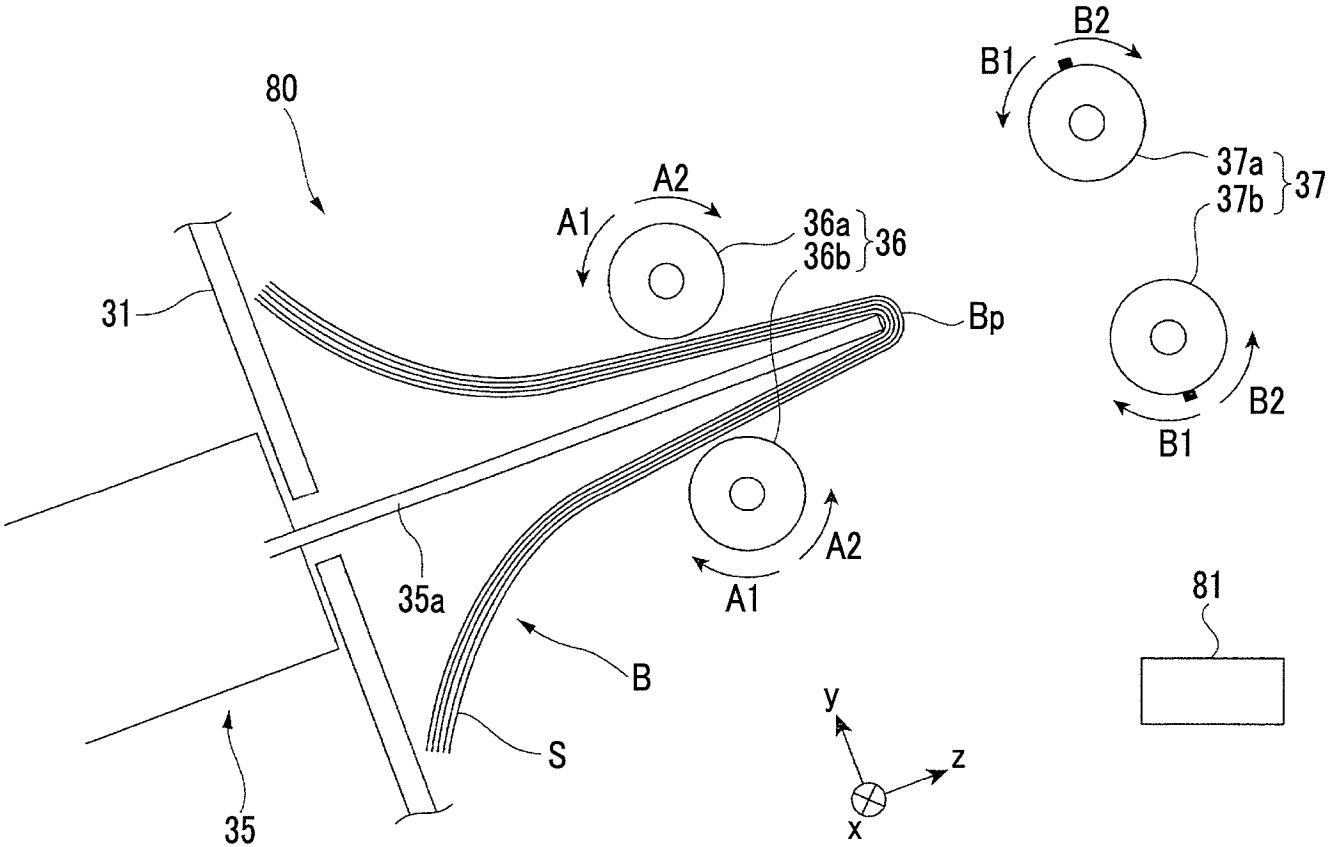
FIG. 4 is a schematic configuration view of a folding mechanism of the exemplary embodiment.

FIG. 4 is a schematic configuration view of the folding mechanism 80 of the exemplary embodiment.

As described above, the folding mechanism 80 includes the folding knife 35, the first folding roll 36, and the second folding roll 37, and simultaneously includes the folding knife 35, the first folding roll 36, and the drive portion 81.

The folding knife 35 includes the knife body 35*a* that is a plate-shaped member of which a side surface thereof is pressed against the sheet bundle B. The knife body 35*a* protrudes from the rear surface side of the compile tray 31 toward the storage surface side (+z direction) and retracts in the opposite direction (−z direction) upon receiving the driving force from the drive portion 81.

Moreover, the knife body 35*a* of the illustrated example is provided so as to be movable to a position in which a leading end thereof passes through between a pair of rolls (a first roll 36*a* and a second roll 36*b*, described below) of the first folding roll 36. Furthermore, the knife body 35*a* is configured such that the leading end thereof retracts in the rear surface direction (−z direction) of the compile tray 31 and does not appear on the surface (storage surface) of the compile tray 31 in a sheet integrating step of the compile tray 31, a saddle stitching step by the stapler 82 (see FIG. 3), or a sheet transport step after the saddle stitching.

The first folding roll 36 includes the first roll 36*a* and the second roll 36*b* that are a pair of roll bodies. The first roll 36*a* and the second roll 36*b* are rotated forward (see arrow A1 in the view) or rotated backward (see arrow A2 in the view), respectively while receiving the driving force from the drive portion 81.

Configuration of Second Folding Roll 37

Next, a configuration of the second folding roll 37 will be described with reference to FIGS. 4, 5, and 6A to 6C.

Figure 5:
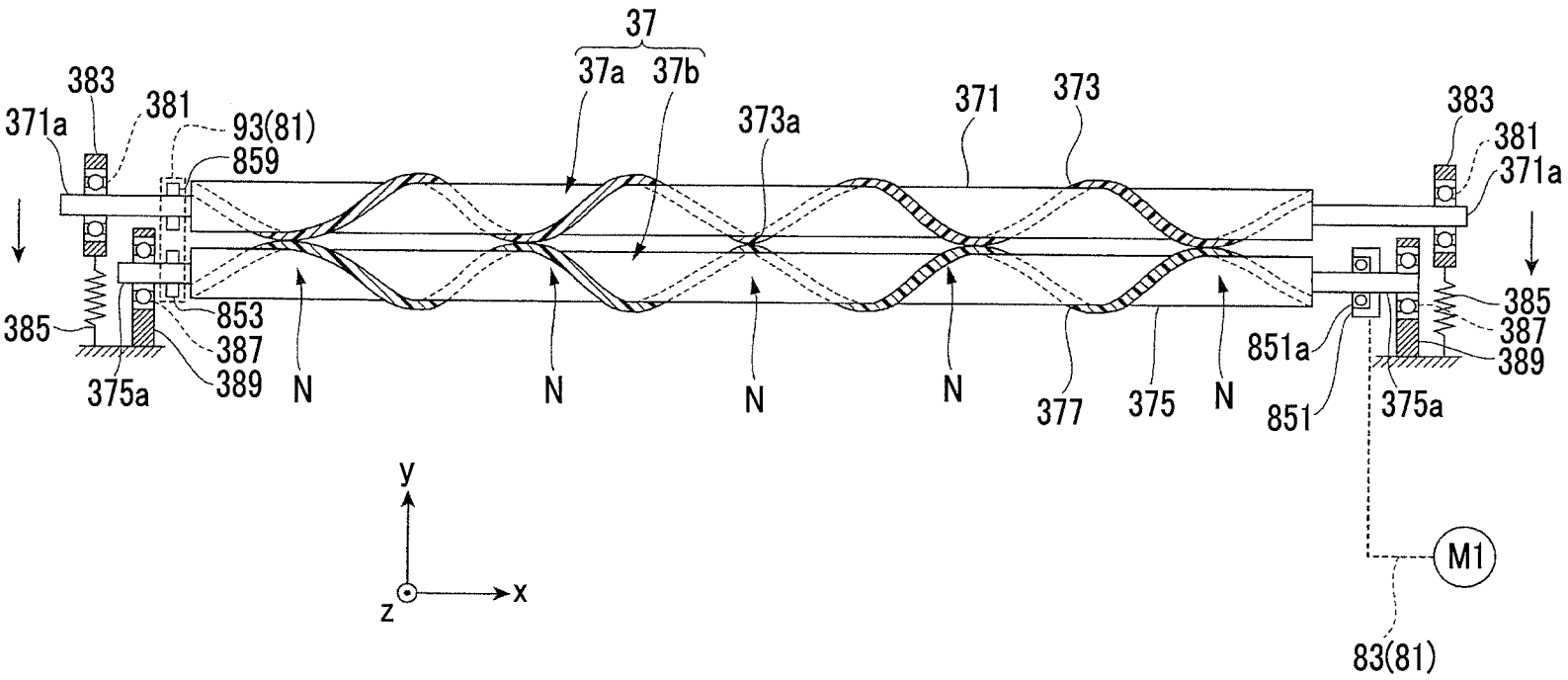
FIG. 5 is a schematic configuration view of a second folding roll of the exemplary embodiment viewed in a −z direction.
Figure 6A:
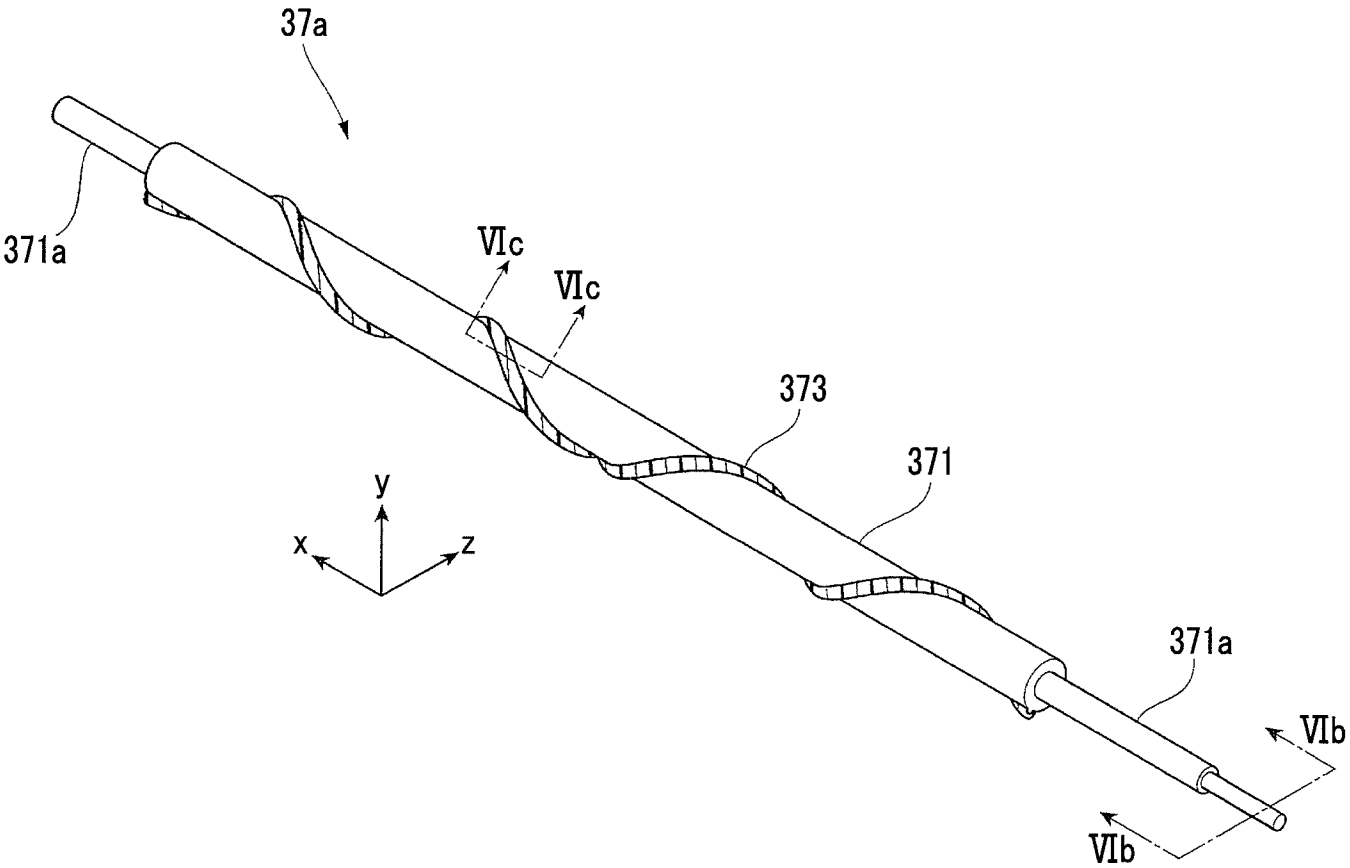
FIGS. 6A to 6C are schematic configuration views of a first spiral roll of the exemplary embodiment.
Figure 6B:
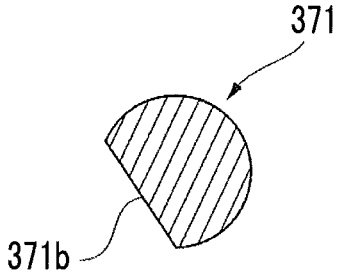
Figure 6C:
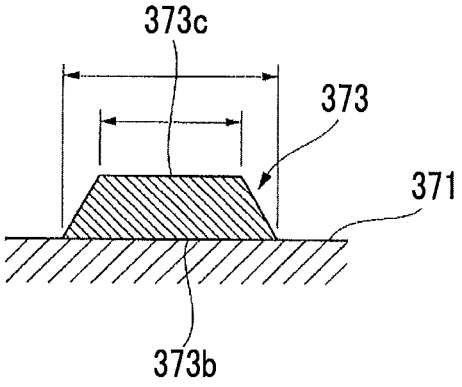

FIG. 5 is a schematic configuration view of the second folding roll 37 of the exemplary embodiment viewed in the −z direction. FIGS. 6A to 6C are schematic configuration views of a first spiral roll 37*a* of the exemplary embodiment. More specifically, FIG. 6A is a perspective view of the first spiral roll 37*a*, FIG. 6B is a cross-sectional view taken along line VIb of FIG. 6A, and FIG. 6C is a cross-sectional view taken along line VIc of FIG. 6A.

First, as illustrated in FIG. 4, the second folding roll 37 includes the first spiral roll 37*a* and a second spiral roll 37*b* that are a pair of roll bodies. Then, the first spiral roll 37*a* and the second spiral roll 37*b* of the illustrated example are rotated forward (see arrow B1 in the view) by receiving the driving force from the drive portion 81. Meanwhile, the second spiral roll 37*b* is connected to a drive source (a first motor M1, described below) through a one-way clutch 851*a* (described below) and the first spiral roll 37*a* is connected to the second spiral roll 37*b* through a second gear group 93 (described below). Therefore, both the first spiral roll 37*a* and the second spiral roll 37*b* do not receive the driving force from the drive portion 81 in the direction of the reverse rotation (see arrow B2 in the view).

As illustrated in FIG. 5, the first spiral roll 37*a* has a first rotating shaft 371 in which a small diameter portion 371*a* is formed on both ends and a first nip portion (convex portion)

373 that is spirally attached to an outer periphery of the first rotating shaft 371. Furthermore, the first spiral roll 37*a* includes on both ends a first bearing 381 that is provided in the small diameter portion 371*a* of the first rotating shaft 371, a support member 383 that supports the small diameter portion 371*a* of the first rotating shaft 371 through the first bearing 381, and a biasing member 385 that biases the support member 383 toward the second roll 36*b*. Moreover, a detailed configuration of the support member 383 and the biasing member 385 is described below.

The second spiral roll 37*b* has a second rotating shaft 375 in which a small diameter portion 375*a* is formed on both ends and a second nip portion (convex portion) 377 that is spirally attached to an outer periphery of the second rotating shaft 375. Furthermore, the second spiral roll 37*b* includes on both ends a second bearing 387 that is provided in the small diameter portion 375*a* of the second rotating shaft 375, and a support member 389 that supports the small diameter portion 375*a* of the second rotating shaft 375 through the second bearing 387. Moreover, the second spiral roll 37*b* of the illustrated example is supported by the support member 389 and the position thereof is fixed.

A first gear group 83 configuring the drive portion 81 is connected to an end portion of the second spiral roll 37*b* in the +x direction. Furthermore, the second gear group 93 configuring the drive portion 81 is connected to end portions of the first spiral roll 37*a* and the second spiral roll 37*b* in the −x direction, respectively. The driving force is transmitted to the first spiral roll 37*a* and the second spiral roll 37*b* through the first gear group 83 and the second gear group 93 (a detailed description is described below).

Here, the first spiral roll 37*a* is biased by the support member 383 and the biasing member 385 so that a nip region N is formed by the first nip portion 373 of the first spiral roll 37*a* and the second nip portion 377 of the second spiral roll 37*b*. Furthermore, plural nip regions N in the illustrated example are formed in the intersecting direction (x direction). The folding process of the sheet bundle B passing through the second folding roll 37 is performed while the sheet bundle B is interposed by the first nip portion 373 and the second nip portion 377 in the nip regions N.

Furthermore, the first spiral roll 37*a* is biased by the support member 383 and the biasing member 385 so that the first spiral roll 37*a* and the second spiral roll 37*b* may contact and separate to and from each other depending on the thickness of the sheet bundle B passing between the first spiral roll 37*a* and the second spiral roll 37*b*. In other words, the first spiral roll 37*a* is retractably provided with respect to the second spiral roll 37*b*.

Next, the first rotating shaft 371 of the first spiral roll 37*a* will be described.

As illustrated in FIG. 6A, the first rotating shaft 371 is a substantially cylindrical member in which the small diameter portion 371*a* is formed on both ends. For example, the first rotating shaft 371 is formed by a metal material such as aluminum or a resin material. Furthermore, as illustrated in FIG. 6B, a notch 371*b* configured of a plane formed on an outer peripheral surface of the small diameter portion 371*a* of the first rotating shaft 371 is provided. That is, the first rotating shaft 371 is a columnar member in which a so-called D-cut is made in an end portion. It is possible to fix the first rotating shaft 371 and a fourth relay gear 859 (described below) in a predetermined phase by forming the notch 371*b* when fixing the fourth relay gear 859 in the first rotating shaft 371.

The first nip portion 373 will be described with reference to FIG. 6A again. The first nip portion 373 is made of an elastic member such as urethane, which is spirally wound and fixed on the outer peripheral surface of the first rotating shaft 371. The first nip portion 373 is molded as a separated body from the first rotating shaft 371 and then is fixed on the outer peripheral surface of the first rotating shaft 371 using known adhesive (not illustrated), but may be integrally molded with the first rotating shaft 371. Furthermore, a spiral groove (or protrusion) is formed on the outer peripheral surface of the first rotating shaft 371 and the first nip portion 373 may be formed by applying urethane lining in the groove (or the protrusion).

Moreover, a coefficient of friction of the first nip portion 373 is greater than that of the first rotating shaft 371. Therefore, the first spiral roll 37*a* is configured having a portion in which the coefficient of friction is relatively large and a portion in which the coefficient of friction is relatively small, in the intersecting direction (x direction).

Now, the first nip portion 373 has a symmetrical shape with respect to a center portion of the first rotating shaft 371 in an axial direction (intersecting direction) thereof. In other words, the first nip portion 373 has two spiral members formed on one end side and the other end side of the first rotating shaft 371. Turing directions (directions inclined with respect to the first rotating shaft 371) of the two spiral members are different (opposite) from each other and the two spiral members are connected to each other through a contact point 373*a* that is positioned in the center portion of the first rotating shaft 371 in the axial direction. The sheet bundle B is suppressed to be moved (deviated) in the intersecting direction (x direction) as the first spiral roll 37*a* is rotated by the configuration.

Furthermore, as illustrated in FIG. 6C, in a cross section of the first nip portion 373, a width of a base portion 373*b* fixed on the outer peripheral surface of the first rotating shaft 371 is wider than that of a top portion 373*c* that is pressed against the sheet bundle B and the cross section thereof is substantially trapezoidal. An area of the top portion 373*c* in contact with the sheet bundle B is suppressed while securing a contact area between the first nip portion 373 and the first rotating shaft 371 by the configuration. Regarding dimensions of the first nip portion 373, for example, the width of the base portion 373*b* is 10 mm to 30 mm, the width of the top portion 373*c* is 1 mm to 10 mm, and a height from the outer peripheral surface of the first rotating shaft 371 is 1 mm to 15 mm. Moreover, in the illustrated example, the top portion 373*c* is a flat surface and the first nip portion 373 is protected from damage due to concentration of a load.

Moreover, even though a detailed description is omitted, as illustrated in FIG. 5, the second rotating shaft 375 of the second spiral roll 37*b* has the same configuration as that of the first rotating shaft 371 of the first spiral roll 37*a* except for a difference in lengths in the axial direction. In other words, notches (not illustrated) that are flat surfaces formed on the outer peripheral surface are provided on both ends of the second rotating shaft 375 and it is possible to fix the second rotating shaft 375, a second spiral roll gear 851 (described below), and a first relay gear 853 (described below) in a predetermined phase when fixing the second spiral roll gear 851 and the first relay gear 853 to the second rotating shaft 375.

Furthermore, the second nip portion 377 of the second spiral roll 37*b* has the same configuration as that of the first nip portion 373 of the first spiral roll 37*a* except that the turning directions of the spirals are opposite. In other words, the first nip portion 373 and the second nip portion 377 are configured such that pitches of the spirals are equal to each other. Furthermore, in the illustrated example, the first nip portion 373 and the second nip portion 377 are configured such that other dimensions such as the respective widths of the base portion 373*b* or the top portion 373*c*, or the height from the base portion 373*b* to the top portion 373*c* are equal to each other.

Configuration of Drive Portion 81

Next, a configuration of the drive portion 81 will be described.

Figure 7A:
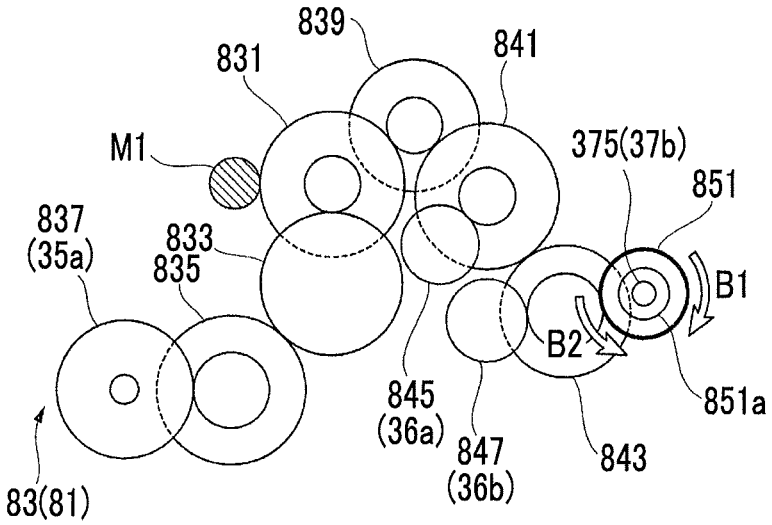
FIGS. 7A and 7B are schematic configuration views of a drive portion and FIG. 7C is a view illustrating a configuration of a periphery of a third relay gear and a fourth relay gear.
Figure 7B:
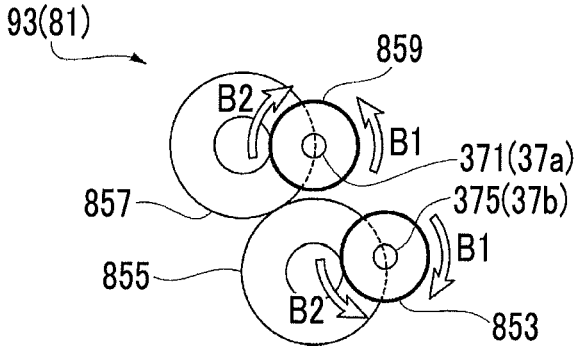
Figure 7C:
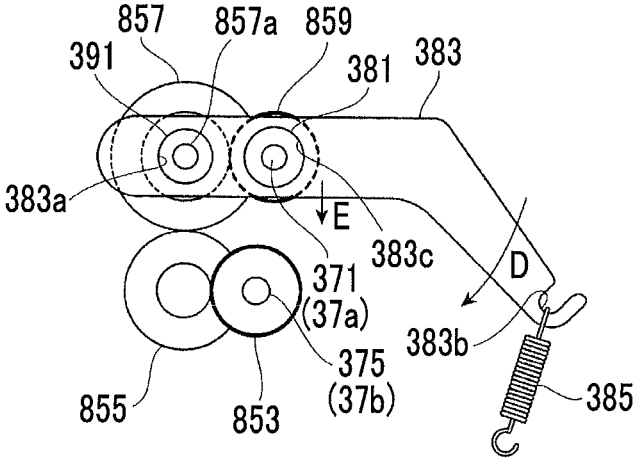

FIGS. 7A and 7B are schematic configuration views of the drive portion 81 and FIG. 7C is a view illustrating a configuration of a periphery of a third relay gear 857 and the fourth relay gear 859. More specifically, FIG. 7A is a schematic configuration view of the first gear group 83 and FIG. 7B is a schematic configuration view of the second gear group 93. Furthermore, both of FIGS. 7A to 7C are views of the drive portion 81 and the like in the +x direction.

As illustrated in FIGS. 7A and 7B, the drive portion 81 includes the first motor M1 that is a drive source, the first gear group 83 that is provided on the end portion of the second folding roll 37 (see FIG. 5) in the +x direction and is rotated by receiving the drive of the first motor M1, and the second gear group 93 that is provided on the end portion of the second folding roll 37 in the −x direction and is rotated by receiving the drive of the first gear group 83 through the second spiral roll 37*b*.

First, the first motor M1 is an electric motor capable of rotating forward and rotating backward.

Next, the first gear group 83 will be described with reference to FIG. 7A.

The first gear group 83 includes a first gear 831 that is rotated by receiving the drive of the first motor M1, a second gear 833 and a third gear 835 that transmit the drive from the first gear 831, and a knife body gear 837 that is provided in the knife body 35*a* and is rotated by receiving the drive from the third gear 835. Furthermore, the first gear group 83 includes a third gear 839, a fourth gear 841, and fifth gear 843 that transmit the drive from the first gear 831.

Furthermore, the first gear group 83 has a first folding roll gear 845 that is provided in the first roll 36*a* of the first folding roll 36 (see FIG. 4) and is rotated by receiving the drive of the fourth gear 841, and a second folding roll gear 847 that is provided in the second roll 36*b* of the first folding roll 36 and is rotated by receiving the drive of the fifth gear 843. Furthermore, the first gear group 83 has the second spiral roll gear 851 that is provided in the second spiral roll 37*b* of the second folding roll 37 and is rotated by receiving the drive of the fifth gear 843.

Here, the one-way clutch 851*a* is disposed inside the second spiral roll gear 851. The one-way clutch 851*a* transmits the drive to the second spiral roll 37*b* when the second spiral roll 37*b* receives the rotating forward drive (see arrow B1 in the view). However, the one-way clutch 851*a* idles without transmitting the drive to the second spiral roll 37*b* when receiving the rotating backward drive (see arrow B2 in the view) from the first motor M1.

Next, the second gear group 93 will be described with reference to FIG. 7B.

The second gear group 93 includes the first relay gear 853 that is provided in the second spiral roll 37*b* that is rotated by receiving the drive from the first motor M1, a second relay gear 855 and the third relay gear 857 that transmit the drive from the first relay gear 853, and the fourth relay gear 859 that is provided in the first spiral roll 37*a* of the second folding roll 37 and is rotated by receiving the drive from the third relay gear 857.

Here, the number of teeth of the first relay gear 853 is the same as that of the fourth relay gear 859. Therefore, the first relay gear 853 and the fourth relay gear 859 that are rotated by receiving the drive from the first motor M1 that is a drive source common to both are rotated at the same speed. Therefore, the second spiral roll 37*b* and the first spiral roll 37*a* to which the first relay gear 853 and the fourth relay gear 859 are respectively attached are also rotated at the same speed. As a result, a state where the nip region N is formed by the first nip portion 373 and the second nip portion 377 is maintained in any position in the intersecting direction (x direction) in a region where the first spiral roll 37*a* and the second spiral roll 37*b* face each other regardless of rotation angles (phases) of the first spiral roll 37*a* and the second spiral roll 37*b*.

Meanwhile, as described above, the first spiral roll 37*a* is supported by the support member 383 and the biasing member 385, and is capable of retracting with respect to the second spiral roll 37*b*. Then, even if the first spiral roll 37*a* is retracted with respect to the second spiral roll 37*b*, the fourth relay gear 859 provided in the first spiral roll 37*a* maintains a state of being engaged with the third relay gear 857 that transmits the drive to the fourth relay gear 859. Hereinafter, a configuration in which the engagement between the fourth relay gear 859 and the third relay gear 857 is maintained will be described in detail.

First, as illustrated in FIG. 7C, the support member 383 is a long plate-shaped member. The support member 383 includes a first opening portion 383*a* that is provided on one end, a concave portion 383*b* that is provided on the side surface of the other end, and a second opening portion 383*c* that is provided between the first opening portion 383*a* and the concave portion 383*b*, and on the side close to the first opening portion 383*a*. Here, a third bearing 391 supporting a rotating shaft 857*a* of the third relay gear 857 is fitted inside the first opening portion 383*a* of the support member 383, one end of the biasing member 385 is hung at the concave portion 383*b*, and the first rotating shaft 371 of the first spiral roll 37*a* is disposed in the second opening portion 383*c* through the first bearing 381. Moreover, as described above, the fourth relay gear 859 is provided in the first rotating shaft 371 of the first spiral roll 37*a*.

Here, the rotating shaft 857*a* of the third relay gear 857 is supported on, for example, a housing (not illustrated) and the position thereof is fixed. Furthermore, the support member 383 is capable of rotating around the rotating shaft 857*a*.

Furthermore, in the illustrated example, the biasing member 385 is a coil spring (elastic member) and is connected to the support member 383 by hanging one end thereof on the concave portion 383*b* of the support member 383 as described above.

Meanwhile, the support member 383 receives a force that makes the support member 383 rotate around the rotating shaft 857*a* of the third relay gear 857 using the biasing member 385 connected to the concave portion 383*b* (see arrow D in the view). As a result, the first rotating shaft 371 that is supported by the second opening portion 383*c*, that is, the first spiral roll 37*a* is biased toward the second spiral roll 37*b* (see arrow E in the view).

Here, as described above, the support member 383 is rotated around the rotating shaft 857*a* of the third relay gear 857. Therefore, when the first spiral roll 37*a* is advanced and retracted with respect to the second spiral roll 37*b*, that is, when the support member 383 is rotated, a distance between the first rotating shaft 371 that is supported by the second opening portion 383*c* of the support member 383 and is a rotational center of the fourth relay gear 859, and the rotating shaft 857*a* of the third relay gear 857 is not changed. That is, a distance between the third relay gear 857 and the fourth relay gear 859 is not changed and a state of being engaged with each other is maintained.

When further describing, even if the first spiral roll 37*a* is advanced and retracted with respect to the second spiral roll 37*b*, the fourth relay gear 859 and the first relay gear 853 are maintained in a state of being engaged with each other through the third relay gear 857 and the second relay gear 855. Therefore, even if the position of the first spiral roll 37*a* is changed, a relative position (phase) between the fourth relay gear 859 and the first relay gear 853 is maintained.

Moreover, here, it is described that the first gear group 83 is provided in the end portion of the second folding roll 37 in the +x direction and the second gear group 93 is provided in the end portion in the −x direction, but the invention is not limited to such a configuration. That is, the first gear group 83 may be provided in the end portion of the second folding roll 37 in the −x direction and the second gear group 93 may be provided in the end portion in the +x direction. Otherwise, both of the first gear group 83 and the second gear group 93 may be provided in any one of end portions of the second folding roll 37 in the +x direction or the −x direction.

Sheet Processing Control Portion 7

Next, a function of the sheet processing control portion 7 that controls each function portion of the post-processing device 2 will be described.

Figure 8:
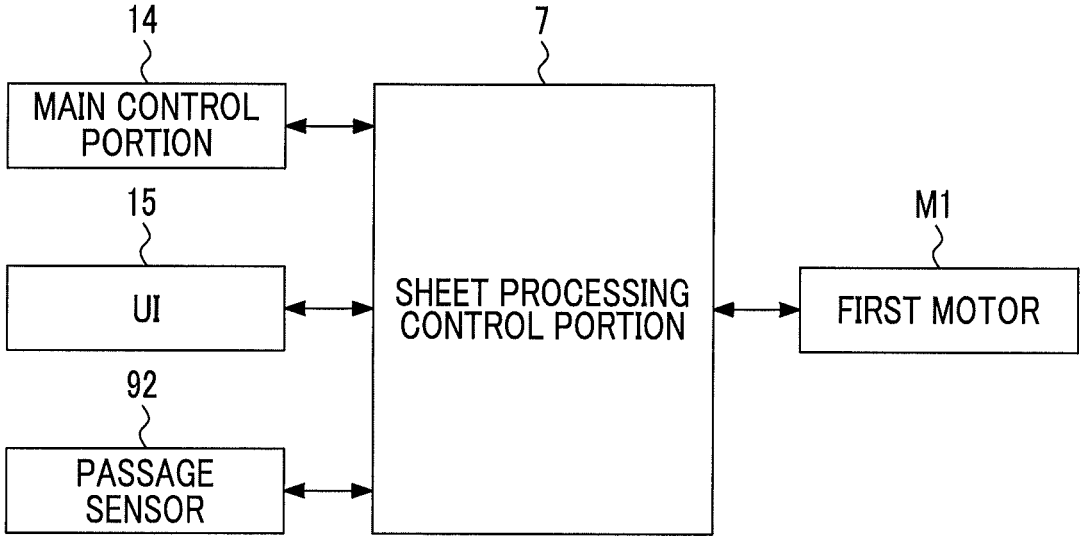
FIG. 8 is a block view of a function of a sheet processing control portion.

FIG. 8 is a block view of the function of the sheet processing control portion 7.

In the exemplary embodiment, information of the process (folding process) of the sheet bundle B that is to be formed is input from the main control portion 14 of the image forming apparatus 1 into the sheet processing control portion 7. Furthermore, a processing signal for the process (folding process) performed in the sheet bundle B, which is received through the user interface (UI) 15, is input into the sheet processing control portion 7. Furthermore, a detection signal indicating that the sheet S is detected is input from the passage sensor 92 into the sheet processing control portion 7.

The sheet processing control portion 7 outputs the control signal to the first motor M1, based on the signals input from the main control portion 14, the user interface 15, and the passage sensor 92.

Moreover, even though not illustrated, the sheet processing control portion 7 also outputs the control signal to a function portion other than the saddle stitching bookbinding function portion 30 such as the stapler 82, or to each function portion of the punch function portion 70 and the end stitching function portion 40.

The sheet processing control portion 7 is configured by including a Central Processing Unit (CPU), a Read Only Memory (ROM), a Random Access Memory (RAM), and a Hard Disk Drive (HDD) (not illustrated). A processing program is executed in the CPU. Various programs, various tables, parameters, and the like are stored in the ROM. The RAM is used as a work area and the like when executing various programs by the CPU.

Operation of the Saddle Stitching Bookbinding Function Portion 30

Next, an operation of the saddle stitching bookbinding function portion 30 will be described.

Here, first, an aspect of a basic operation of the saddle stitching bookbinding function portion 30 is described with reference to FIGS. 3 and 4 and then an operation of the folding process by the folding mechanism 80 is described in detail with reference to FIGS. 9A to 9F.

FIGS. 9A to 9F are views illustrating the operation of the folding process of the folding mechanism 80. Moreover, the description of the folding knife 35 is omitted in FIGS. 9A to 9F.

As illustrated in FIG. 3, when making the booklet, the finisher unit 5 receives the sheet S on which the image formation (print) is completed, which is output through a discharge roll 46 of the folding unit 4 in a sheet carry-in port 71, and the sheet S passes through an inlet roll 41 provided in the vicinity of the sheet carry-in port 71, and then a punching (drilling) process is performed in the punch function portion 70 if necessary. Then, the sheet S passed through the punch function portion 70 is distributed to the saddle stitching bookbinding function portion 30, an upper sheet storage tray (upper sheet stack portion) 49, or the end stitching function portion 40 by a first gate 42.

When discharging the sheet S on which the image formation is completed to the outside or making an end stitched booklet, the sheet S is directed upward in the first gate 42 and is transported further upward by a transport roll 43, based on the control signal from the sheet processing control portion 7, and is transported to the upper sheet storage tray 49 or the end stitching function portion 40. Meanwhile, when making a saddle stitched booklet, the sheet S is directed downward in the first gate 42, based on the control signal from the sheet processing control portion 7 and is transported to the carry-in roll 39 through a transport roll 44.

The carry-in roll 39 stacks the transported sheet S on the compile tray 31 in order so as to integrate the sheet S in the compile tray 31. For example, the number of sheets that are set in the main control portion 14 (see FIG. 1) of the image forming apparatus 1, for example five sheets, and ten sheets are integrated in the compile tray 31.

At this time, the passage sensor 92 outputs the detection signal to the sheet processing control portion 7 whenever each of the sheets S is transported by the carry-in roll 39. Furthermore, the sheet alignment paddle 33 rotates toward the end guide 32 and presses the integrated sheets S against the end guide 32 and then assists in the sheet alignment. Furthermore, the sheet width alignment member 34 slidingly moves in the width direction of the sheet S integrated in the compile tray 31 whenever each of the sheets S is transported and performs the sheet alignment with respect to the integrated sheets S in the width direction.

Then, the predetermined number of the sheets S are integrated and the sheet bundle B is formed on the compile tray 31. Then, the staples (not illustrated) are disposed by the stapler 82 with respect to the sheet bundle B and the stitching process is performed.

Then, the end guide 32 moves to the upstream side (y direction) of the sheet S in the storage surface of the compile tray 31 and a portion (center portion in the transporting direction) in which the staples (not illustrated) of the sheet bundle B are disposed is a position facing the leading end of the knife body 35*a*. When the sheet bundle B reaches the position, the knife body 35*a* of the folding mechanism 80 is extruded from the rear surface side of the compile tray 31 toward the storage surface side (z direction) and performs the folding process in the sheet bundle B while passing through the first folding roll 36 and the second folding roll 37. Then, the sheet bundle B in which the folding process is performed is discharged by the discharge roll 38 and is stacked on the booklet tray 45.

Folding Processing Operation of Folding Mechanism 80

A folding processing operation by the folding mechanism 80 will be described with reference to FIGS. 9A to 9F.

Figure 9A:
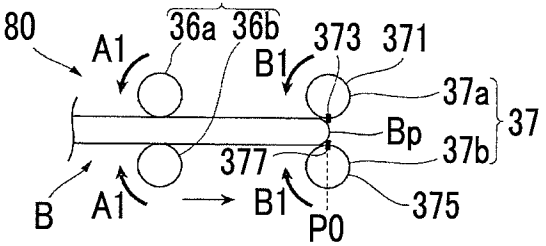
FIGS. 9A to 9F are views illustrating an operation of a folding process of the folding mechanism.

First, as illustrated in FIG. 9A, the sheet bundle B against which the knife body 35*a* (see FIG. 4) of the folding knife 35 abuts is transported while being interposed by the first folding roll 36 and the second folding roll 37, respectively. At this time, the first folding roll 36 and the second folding roll 37 receiving the drive of the first motor M1 that is rotated forward are rotated forward (see arrows A1 and B1 in the view). Here, in the illustrated example, when a leading end (folding stripe) Bp of the sheet bundle B reaches the space between the first spiral roll 37*a* and the second spiral roll 37*b* in the second folding roll 37, the first spiral roll 37*a* and the second spiral roll 37*b* are in a rotation angle (phase) in which the first nip portion 373 and the second nip portion 377 interpose the leading end Bp. Moreover, a position on the sheet transport path in which the first spiral roll 37*a* and the second spiral roll 37*b* are closest to each other is referred to as a reference position P0.

Figure 9B:
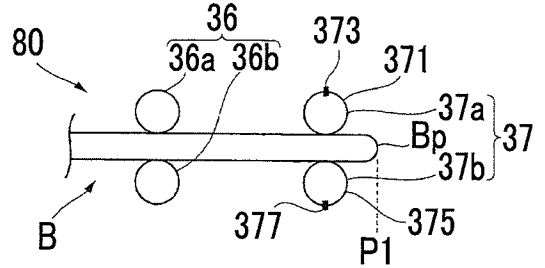

Then, as illustrated in FIG. 9B, when the leading end Bp of the sheet bundle B passes through the reference position P0 and reaches a first position P1 that is a position on the sheet transport path, the first folding roll 36 and the second folding roll 37 are stopped.

Figure 9C:
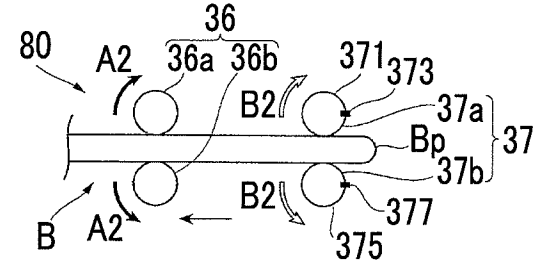

Next, as illustrated in FIG. 9C, the first folding roll 36 is rotated backward (see arrow A2 in the view) by receiving the drive of the first motor M1 that is rotated backward. As a result, the sheet bundle B is pulled back toward the folding knife 35 (see FIG. 4) side. At this time, the second folding roll 37 in which the one-way clutch 851*a* (see FIG. 5) is provided is rotated backward (see arrow B2 in the view) while idling. That is, as described above, the second folding roll 37 does not receive the drive from the first motor M1 that is rotated backward. Meanwhile, the sheet bundle B that is pulled back as the first folding roll 36 is rotated backward, and the second folding roll 37 comes into contact with each other. Therefore, the second folding roll 37 rotates (idles) so as to be dragged by the sheet bundle B.

Figure 9D:
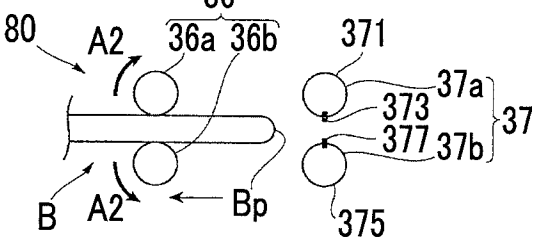

Then, as illustrated in FIG. 9D, when the first motor M1 continuously rotates backward, the sheet bundle B is continuously pulled back by the first folding roll 36 and the sheet bundle B is separated from the second folding roll 37 at a predetermined time. Then, the second folding roll 37 to which the drive from the first motor M1 is not transmitted stops the rotation thereof when the sheet bundle B is separated. Thereafter, in a state where the second folding roll 37 is stopped, the sheet bundle B is moved by the first folding roll 36 and then the phases of the sheet bundle B and the second folding roll 37 deviate (change).

Figure 9E:
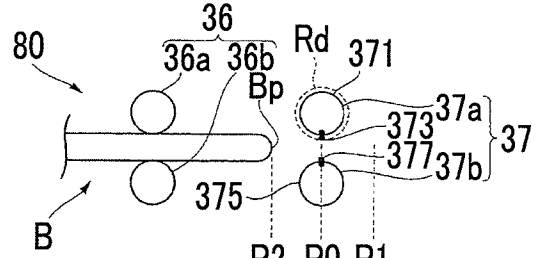

Then, as illustrated in FIG. 9E, when the leading end Bp of the sheet bundle B reaches a second position P2 that is a predetermined position on the sheet transport path, the first folding roll 36 is stopped.

Figure 9F:
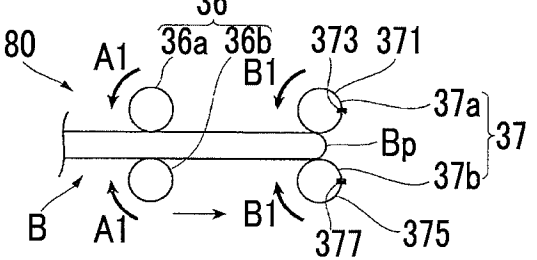

Next, as illustrated in FIG. 9F, the first motor M1 rotates forward again and the first folding roll 36 and the second folding roll 37 that receive the drive of the first motor M1 are rotated forward (see arrows A1 and B1 in the view). Then, the leading end Bp of the sheet bundle B reaches between the first spiral roll 37*a* and the second spiral roll 37*b* in a phase different from the phase illustrated in FIG. 9A.

As described above, in the exemplary embodiment, the folding process is performed while the leading end Bp of the sheet bundle B passes through the second folding roll 37 plural times and, specifically, while the leading end Bp of the sheet bundle B passes through the reference position P0 plural times, by reciprocating the sheet bundle B by the first folding roll 36. For example, the folding process is performed while the leading end Bp of the sheet bundle B passes through the reference position P0 more than two times up to thirty times in the direction from the first folding roll 36 to the second folding roll 37. Moreover, the number of passages is determined, for example, by storing the number in advance in the ROM (not illustrated) of the sheet processing control portion 7 or by receiving the designation from the user through the user interface 15.

Moreover, in the exemplary embodiment, as illustrated in FIG. 9D described above, in a state where the second folding roll 37 is stopped, the phases of the sheet bundle B and the second folding roll 37 are changed while moving the sheet bundle B and a change amount of the phase may be adjusted by changing a distance in which the sheet bundle B is moved, that is, a distance between the reference position P0 and the second position P2. Moreover, if the distance between the reference position P0 and the second position P2 is large, productivity is reduced and if the distance is small, there is a concern that the second folding roll 37 and the sheet bundle B may not separate from each other and the phase may not change.

In the illustrated example, the second position P2 is positioned between the first folding roll 36 and the second folding roll 37 in the sheet transporting direction Moreover, the sheet processing control portion 7 switches the rotation and the stoppage of the first folding roll 36 and the second folding roll 37, for example, based on a time elapsed from when the detection signal from the passage sensor 92 is received by the sheet processing control portion 7. However, for example, another passage sensor (not illustrated) that detects the sheet bundle B passing through the first position P1 and the second position P2 is provided and the sheet processing control portion 7 may control the rotation of the first folding roll 36 and the second folding roll 37 by the detection signal from the other passage sensor.

State of Sheet Bundle B

Next, a state where the second folding roll 37 interposes the sheet bundle B will be described.

Figures 10A, 10B, 10C:
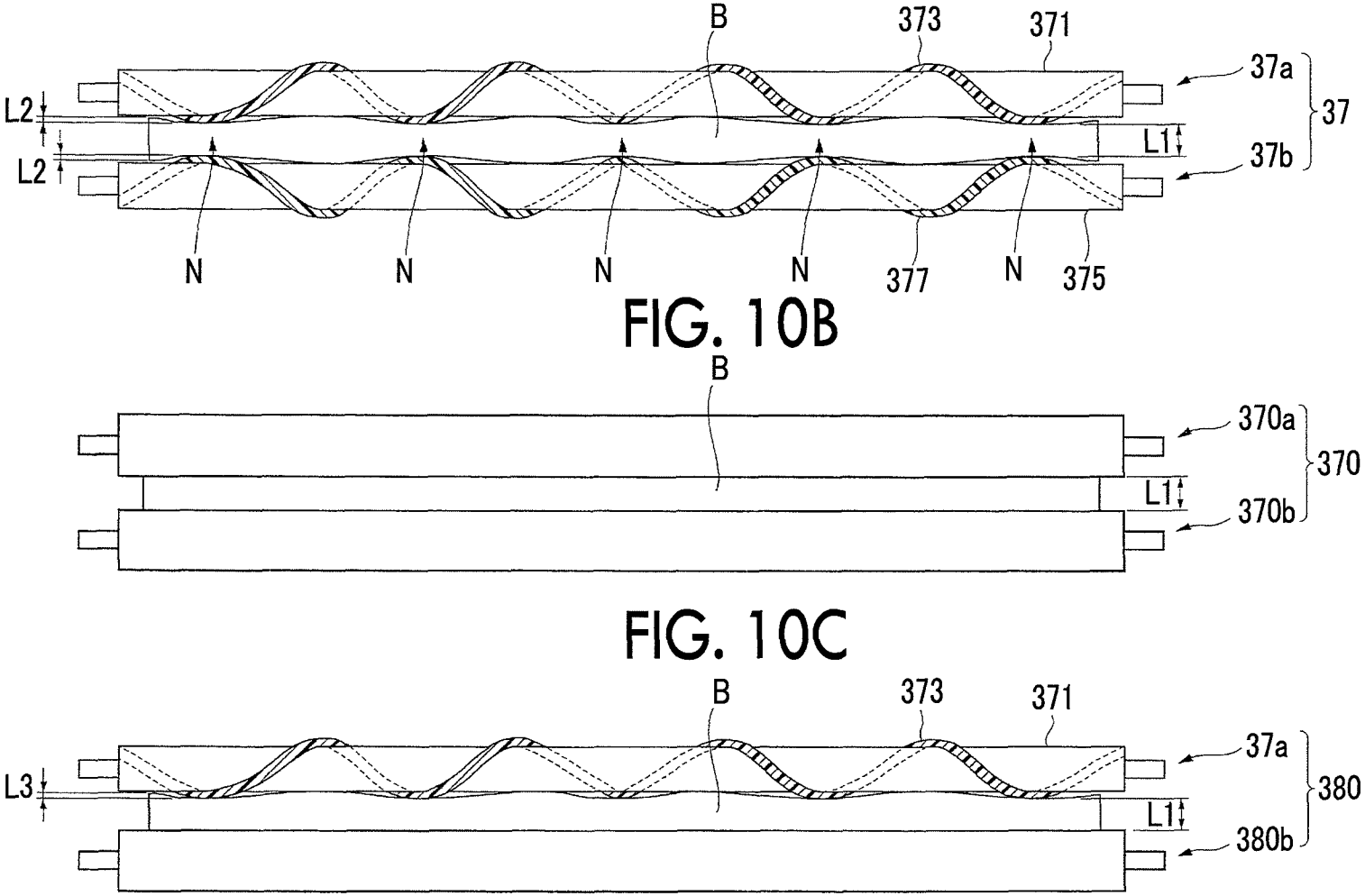
FIGS. 10A to 10C are views illustrating a state where the second folding roll interposes a sheet bundle.

FIGS. 10A to 10C are views illustrating a state where the second folding roll 37 interposes the sheet bundle B. More specifically, FIG. 10A illustrates a state where the second folding roll 37 of the exemplary embodiment interposes the sheet bundle B, FIG. 10B illustrates a state where a roll pair 370 different from the exemplary embodiment interposes the sheet bundle B, and FIG. 10C illustrates a state where a second folding roll 380 in a modification example of the exemplary embodiment interposes the sheet bundle B.

As illustrated in FIG. 10A, the second folding roll 37 of the exemplary embodiment performs the folding process while squeezing a part of the sheet bundle B in the width direction (intersecting direction) by interposing the sheet bundle B between the first nip portion 373 and the second nip portion 377 in plural portions (the nip region N) in the intersecting direction (x direction). As described above, the first nip portion 373 and the second nip portion 377 squeeze a part of the sheet bundle B in the width direction (intersecting direction) so that, a load for pressing together the first spiral roll 37*a* and the second spiral roll 37*b* to perform the folding process in the sheet bundle B is suppressed.

For example, as a comparative example different from the exemplary embodiment, as illustrated in FIG. 10B, a case may be considered in which the sheet bundle B is interposed by the roll pair 370 including a first columnar roll 370*a* and a second columnar roll 370*b* that are rubber rolls in which rubber (elastic member) is wound around outer peripheral surfaces of columnar metal members respectively. The first columnar roll 370*a* and the second columnar roll 370*b* press the sheet bundle B throughout an entire sheet bundle B in the width direction (intersecting direction). Meanwhile, as illustrated in FIG. 10A, in the exemplary embodiment, a part of the sheet bundle B is pressed in the width direction (intersecting direction) of the sheet bundle B. That is, as illustrated in FIG. 10A, in the exemplary embodiment, an area of the portion (the nip region N) pressing the sheet bundle B is smaller than that of the configuration illustrated in FIG. 10B.

Therefore, the load (nip pressure) that is necessary when squeezing the portion of the sheet bundle B that is pressed to the same thickness L1 (be buckled) is smaller in the exemplary embodiment. The first spiral roll 37*a* and the second spiral roll 37*b* are suppressed from bending by decreasing the load when applying the load on the both ends of the first spiral roll 37*a* and the second spiral roll 37*b*. When further describing, for example, the first spiral roll 37*a* and the second spiral roll 37*b* are suppressed from entering a state of being separated from each other in the center portion in the intersecting direction.

Moreover, as illustrated in FIG. 10C, as the modification example of the second folding roll 37 of the exemplary embodiment, one side of the second folding roll 380 may be the first spiral roll 37*a* and the other side may be a third columnar roll 380*b* that is a rubber roll in which the rubber (elastic member) is wound around the outer peripheral surface of the columnar metal member. That is, a spiral member (the first nip portion 373 in the illustrated example) may be provided on the outer peripheral surface of one side roll in the second folding roll 380. In the configuration, the load that is applied to the first spiral roll 37*a* and the third columnar roll 380*b* to press the sheet bundle B is suppressed compared to the roll pair 370 illustrated in FIG. 10B.

Here, when comparing the configuration illustrated in FIG. 10A and the configuration illustrated in FIG. 10C, the applied load is more suppressed in the configuration illustrated in FIG. 10A. When further describing, in the configuration illustrated in FIG. 10A, both surfaces of the sheet bundle B are pressed by the first nip portion 373 and the second nip portion 377, that is, deformation is formed on both surfaces of the sheet bundle B. Meanwhile, in the configuration illustrated in FIG. 10C, only one surface (upper surface in the view) of the sheet bundle B is pressed by the first nip portion 373 and the deformation is formed on only one surface of the sheet bundle B (deformation is concentrated on one side). Therefore, in the configuration illustrated in FIG. 10A and the configuration illustrated in FIG. 10C, when pressing the sheet bundle B to the same thickness L1, the load is smaller in the configuration illustrated in FIG. 10A. Moreover, a depth L2 of the deformation on one side formed in the configuration illustrated in FIG. 10A is smaller than a depth L3 of the deformation formed in the configuration illustrated in FIG. 10C.

Next, a positional relationship between the sheet bundle B on which the folding process is performed and the first nip portion 373 will be described.

Figure 11:
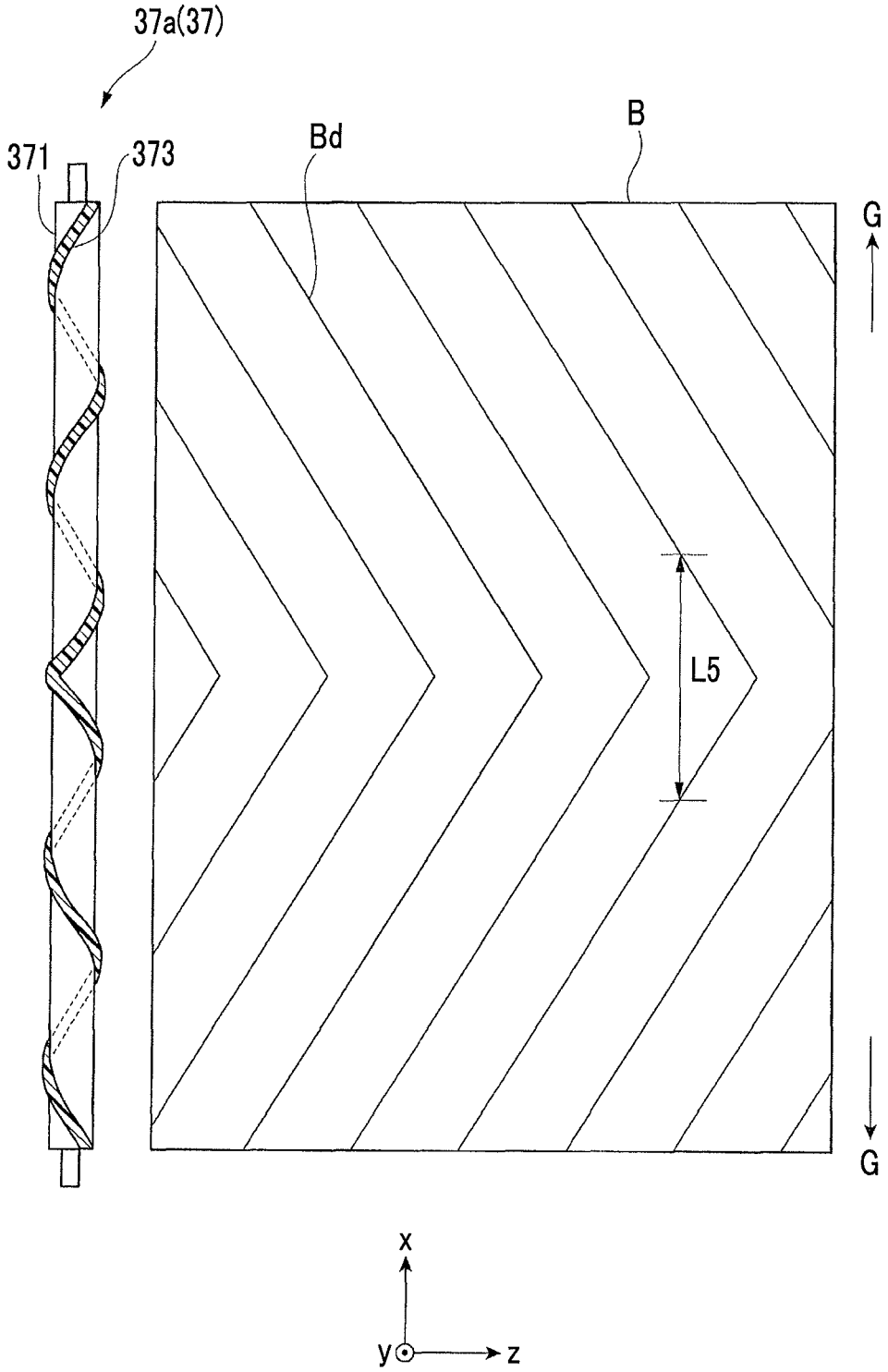
FIG. 11 is a view illustrating a contact portion with which a first nip portion comes into contact in the sheet bundle.

FIG. 11 is a view illustrating a contact portion Bd with which the first nip portion 373 comes into contact with the sheet bundle B.

As illustrated in FIG. 11, when the sheet bundle B passes through the second folding roll 37 a single time in the +z direction, if a portion with which the first nip portion 373 comes into contact in the sheet bundle B is referred to as the contact portion Bd, the contact portion Bd is formed by extending in a direction inclined with respect to the sheet transporting direction (z direction). Furthermore, the contact portion Bd has a symmetrical shape (reversal mirror) with respect to a center portion of the intersecting direction (x direction) and a distance L5 between the contact portion Bd on one side (+x direction) and the contact portion Bd of the other side (−x direction) is formed to be wider going toward the −z direction based on the center portion thereof. In other words, the first nip portion 373 of the second folding roll 37 is configured such that the bending of the sheet bundle B generated by pressing the sheet bundle B is transferred to both of the end sides in the intersecting direction (x direction) as the sheet bundle B is transported in the +z direction (see arrow G). Therefore, the sheet bundle B is suppressed from incurring wrinkles as the second folding roll 37 presses the sheet bundle B. In other words, in the illustrated example, since the coefficient of friction of the first rotating shaft 371 is smaller than that of the first nip portion 373, the movement of the bending of the sheet bundle B is suppressed from being hindered when the bending of the sheet bundle B is transferred to both of the end sides in the intersecting direction (x direction).

Next, change in the position of the contact portion Bd as the sheet bundle B is reciprocated will be described.

Figure 12A:
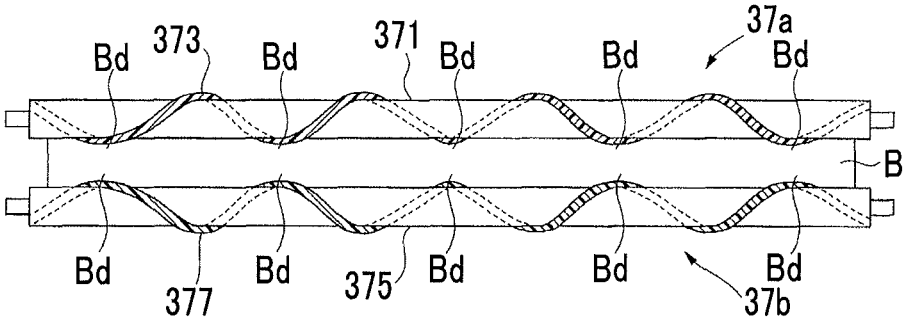
FIGS. 12A to 12D are views illustrating a change in position of the contact portion as the sheet bundle is reciprocated.
Figure 12B:
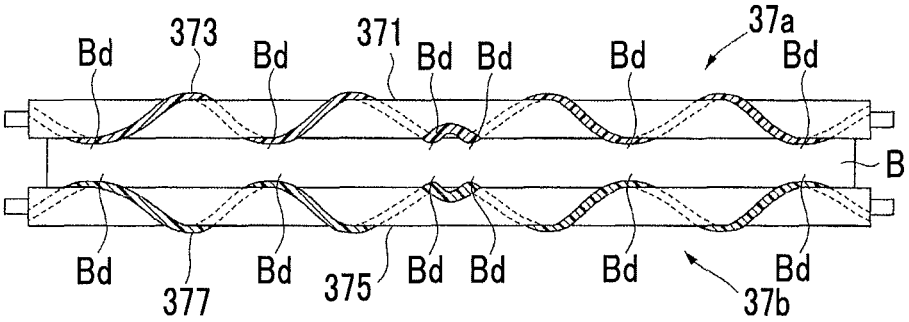
Figure 12C:
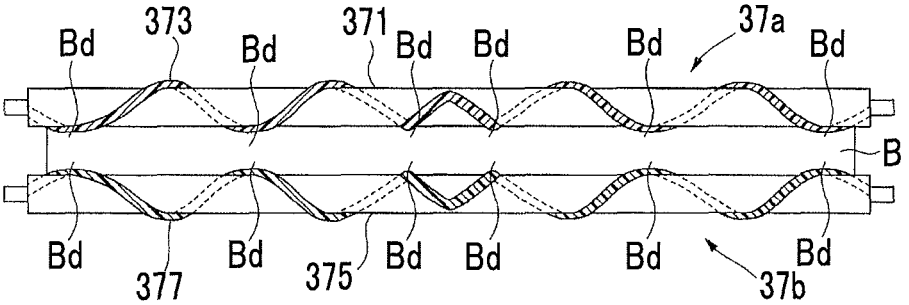
Figure 12D:
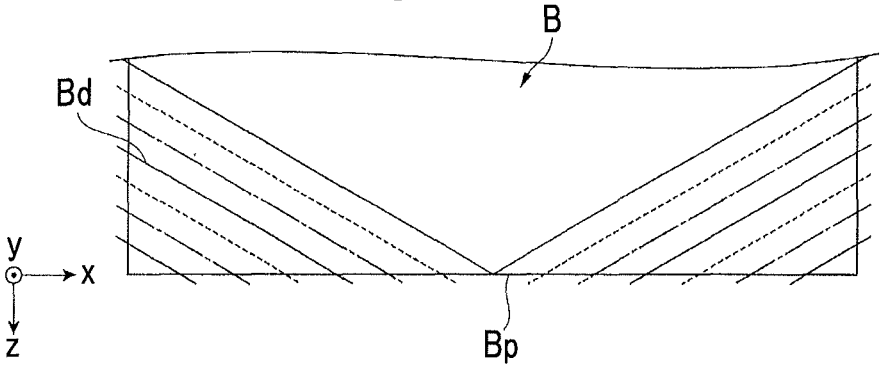

FIGS. 12A to 12D are views illustrating the change in the position of the contact portion Bd as the sheet bundle B is reciprocated. More specifically, FIG. 12A illustrates the position of the contact portion Bd when passing through the second folding roll 37 in the +z direction a first time, FIG. 12B illustrates the position of the contact portion Bd when passing through the second folding roll 37 in the +z direction a second time, and FIG. 12C illustrates the position of the contact portion Bd when passing through the second folding roll 37 in the +z direction a third time. FIG. 12D illustrates the contact portion Bd formed in the sheet bundle B, as a result of the operation illustrated in FIGS. 12A to 12C.

First, as illustrated in FIGS. 12A to 12C, the positions of the contact portion Bd formed on the both surfaces of the sheet bundle B are positions (the same position) corresponding to each other in the intersecting direction (x direction). Furthermore, when the sheet bundle B passes through the second folding roll 37 plural times by reciprocating the sheet bundle B, the position of the contact portion Bd formed in the sheet bundle B is changed. In the illustrated example, the position of the contact portion Bd in the intersecting direction (x direction) is deviated whenever passing through the second folding roll 37.

Furthermore, as illustrated in FIG. 12D, also in the leading end Bp of the sheet bundle B, the position of the contact portion Bd formed by the first nip portion 373 (and the second nip portion 377) is moved whenever passing through the second folding roll 37. That is, the positions of the contact portion Bd (see the contact portion Bd indicated in a solid line in the view) when passing through the first time, the contact portion Bd (see the contact portion Bd indicated in a broken line in the view) when passing through the second time, and the contact portion Bd (see the contact portion Bd indicated in a chain line in the view) when passing through the third time are deviated from each other. Therefore, the folding process in the leading end Bp of the sheet bundle B is further favorably performed. When further describing, the sheet bundle B is suppressed from bulging.

As illustrated in FIG. 9E described above, the phases of the sheet bundle B and the second folding roll 37 may be deviated by separating the second folding roll 37 from the sheet bundle B, when reciprocating the sheet bundle B.

Therefore, it may be understood that the first gear group 83 and the second gear group 93 (see FIGS. 7A and 7B) are configured such that the phases of the sheet bundle B and the second folding roll 37 are deviated when the sheet bundle B and the second folding roll 37 are separated from each other. When further describing, that the first gear group 83 and the second gear group 93 are configured such that the position in which the contact portion Bd in the sheet bundle B is moved when reciprocating the sheet bundle B in the region across the second folding roll 37 in the transporting direction may be understood. In other words, the first gear group 83 and the second gear group 93 are configured such that the sheet bundle B is gradually folded by transferring the sheet bundle B to and from the second folding roll 37 plural times.

Meanwhile, as described above, the dimensions of the apparatus are small, for example, compared to a configuration in which plural rolls are provided along the transporting direction different from in the exemplary embodiment by reciprocating the sheet bundle B and by repeating the folding process plural times by the second folding roll 37.

Furthermore, for example, it is possible to realize the exemplary embodiment by replacing a transport roll (not illustrated) provided in the post-processing device (not illustrated) of the related art different from in the exemplary embodiment by including the second folding roll 37 described above, and by changing the settings of a control portion (not illustrated) provided in the post-processing device of the related art. In other words, it is sufficient by changing only the settings of the control portion and, for example, exchanging a substrate (not illustrated) or the like which is a member configuring the control portion is not necessary in principle.

Other Exemplary Embodiment 1

Another exemplary embodiment 1 is described.

Figure 13:
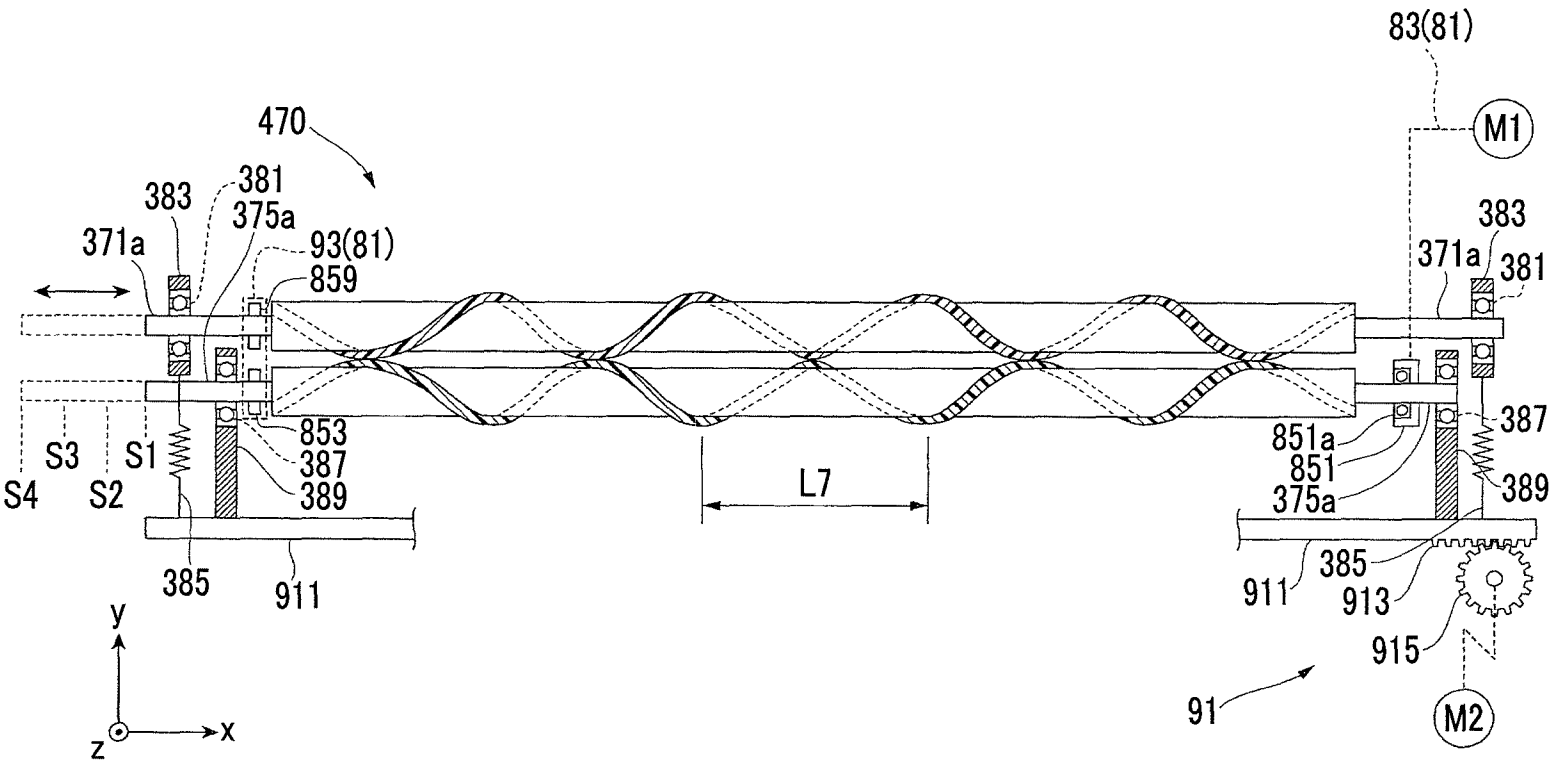
FIG. 13 is a schematic configuration view of a second folding roll in another exemplary embodiment 1.

FIG. 13 is a schematic configuration view of a second folding roll 470 in the other exemplary embodiment 1.

Moreover, in the following description, the same symbol is given to the same function member as the second folding roll illustrated in FIG. 5 described above and detailed description thereof will be omitted.

The second folding roll 470 includes a moving mechanism 91 that moves the first spiral roll 37*a* and the second spiral roll 37*b* in the intersecting direction (x direction).

The moving mechanism 91 includes a base member 911 that supports the first spiral roll 37*a* and the second spiral roll 37*b*, a rack gear 913 that is provided in the base member 911, a pinion gear 915 that is engaged with the rack gear 913, and a second motor M2 that supplies a driving force to the pinion gear 915.

Then, the moving mechanism 91 may move the first spiral roll 37*a* and the second spiral roll 37*b* as the base member 911 is moved in the intersecting direction (x direction) by receiving the drive of the second motor M2. In the illustrated example, in the moving mechanism 91, the first spiral roll 37*a* and the second spiral roll 37*b* are capable of being disposed in four portions (S1 to S4) with a gap smaller than a distance (pitch) L7 between spirals adjacent to each other in the first nip portion 373 (or the second nip portion 377).

The moving mechanism 91 moves (offsets) the first spiral roll 37*a* and the second spiral roll 37*b* in the intersecting direction (x direction) while maintaining a state where the first spiral roll 37*a* and the second spiral roll 37*b* face each other in the period illustrated in FIG. 9D described above, that is, when the sheet bundle B is pulled back by the first folding roll 36 and the sheet bundle B is separated from the second folding roll 470. Specifically, for example, the first spiral roll 37*a* and the second spiral roll 37*b* are moved from a position 51 to a position S2 in synchronization. Therefore, when the sheet bundle B passes through the second folding roll 470 again, the position of the contact portion Bd formed in the sheet bundle B is moved. Furthermore, a state where the contact portion Bd formed on one surface of the sheet bundle B is positioned in the same position as the contact portion Bd formed on the other surface in the intersecting direction (x direction) is maintained.

Moreover, a driving period of the moving mechanism 91 is determined by the sheet processing control portion 7, for example, based on time elapsed from when the detection signal from the passage sensor 92 (see FIG. 3) is received by the sheet processing control portion 7 (see FIG. 3). However, for example, another passage sensor (not illustrated) that detects the sheet bundle B passing through the first position P1 and the second position P2 (see FIG. 9E) is provided and the sheet processing control portion 7 may control the moving mechanism 91 with the detection signal from the other passage sensor.

Furthermore, in the exemplary embodiment, it is possible to suppress an amount (distance) of the sheet bundle B from being pulled back, for example, by the first folding roll 36 compared to the exemplary embodiment described using FIG. 5 and the like.

Other Exemplary Embodiment 2

Next, another exemplary embodiment 2 will be described.

Figure 14A:
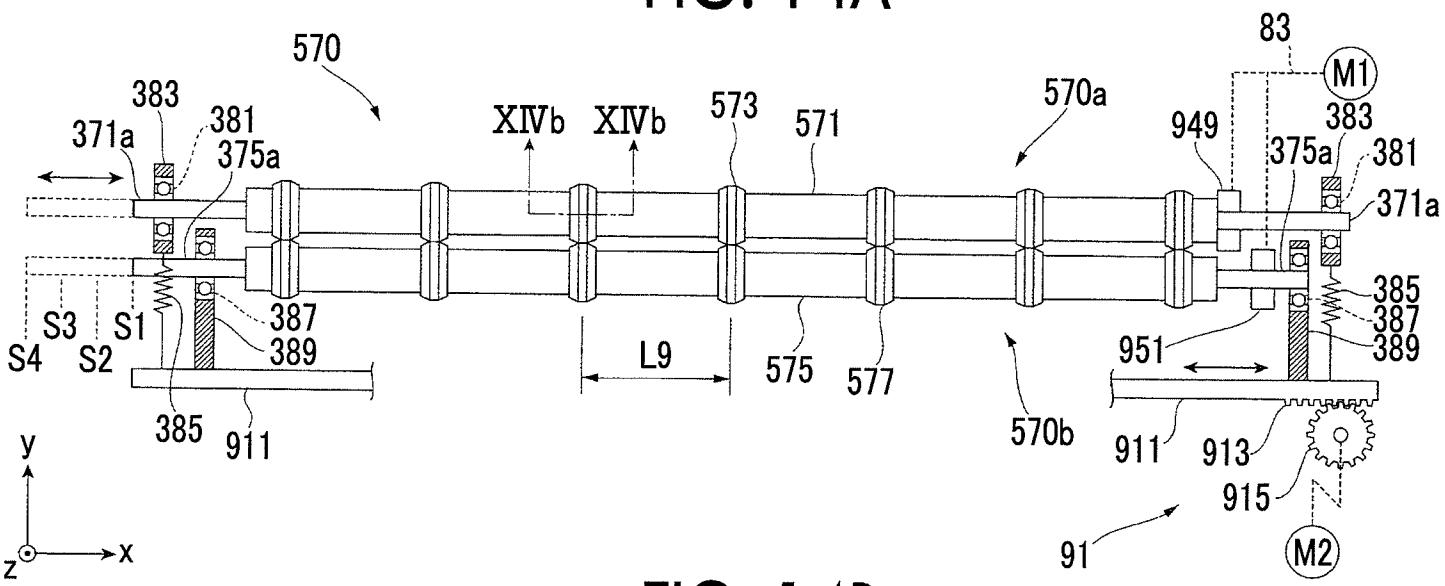
FIG. 14A is a schematic configuration view of a second folding roll in another exemplary embodiment 2 and FIG. 14B is a cross-sectional view taken along line XIVb of FIG. 14A.
Figure 14B:
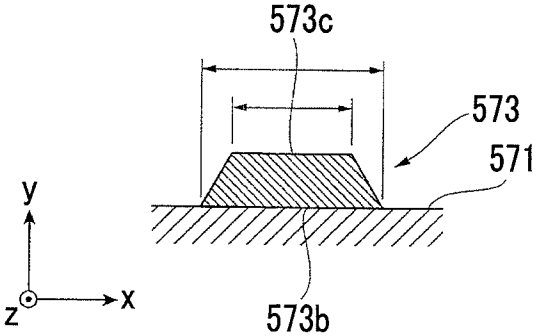

FIG. 14A is a schematic configuration view of a second folding roll 570 in another exemplary embodiment 2 and FIG. 14B is a cross-sectional view taken along line XIVb of FIG. 14A.

Moreover, in the following description, the same symbol is given to the same function member as the second folding roll 37 illustrated in FIG. 5 or the second folding roll 470 illustrated in FIG. 13 described above and detailed description thereof will be omitted.

First, it is described that the first nip portion 373 and the second nip portion 377 are spirally attached to the outer periphery of the first rotating shaft 371 and the second rotating shaft 375, respectively, are provided in the second folding roll 37 illustrated in FIG. 5 described above.

Meanwhile, the second folding roll 570 illustrated in FIG. 14A includes a first different diameter roll 570*a* and a second different diameter roll 570*b*. Then, the first different diameter roll 570*a* includes a first rotating shaft 571 and a first large diameter portion 573 which is provided on an outer periphery of the first rotating shaft 571 and of which an outer diameter is greater than that of the first rotating shaft 571. Furthermore, the second different diameter roll 570*b* includes a second rotating shaft 575 and a second large diameter portion 577 which is provided on an outer periphery of the second rotating shaft 575 and of which an outer diameter is greater than that of the second rotating shaft 575. The first large diameter portion 573 and the second large diameter portion 577 are provided in positions (same position) corresponding to each other in the intersecting direction (x direction) and are provided as plural numbers with the predetermined gap (distance L9) in the illustrated example. Moreover, it may be understood that the first different diameter roll 570*a* and the second different diameter roll 570*b* are configurations including plural rolls of small width, respectively.

Furthermore, it is described that the second spiral roll gear 851 including the one-way clutch 851*a* is provided in the second folding roll 37 illustrated in FIG. 5 described above.

Meanwhile, a first drive gear 949 and a second drive gear 951 capable of transmitting a driving force for forward rotation and reverse rotation to the first different diameter roll 570*a* and the second different diameter roll 570*b* are provided in the second folding roll 570 illustrated in FIG. 14A. Then, the second folding roll 570 is rotated forward and rotated backward by receiving the driving force from the first motor M1 through the first drive gear 949 and the second drive gear 951.

Here, the first large diameter portion 573 and the second large diameter portion 577 are formed of an elastic member such as urethane. Furthermore, as illustrated in FIG. 14B, in the first large diameter portion 573, a width of the base member 573*b* fixed to an outer peripheral surface of the first rotating shaft 571 is wider than that of a top portion 573*c* that is pressed against the sheet bundle B. Therefore, the first large diameter portion 573 is configured such that an area of the top portion 573*c* coming into contact with the sheet bundle B is suppressed while securing a contact area with the first rotating shaft 571.

Furthermore, the moving mechanism 91 may move the first different diameter roll 570*a* and the second different diameter roll 570*b* in the intersecting direction (x direction). In the illustrated example, in the moving mechanism 91, the first different diameter roll 570*a* and the second different diameter roll 570*b* may be disposed in four portions (S1 to S4) with gaps smaller than a distance (pitch) L9 between the first large diameter portions 573 (or the second large diameter portions 577) adjacent to each other.

Furthermore, the moving mechanism 91 moves the first different diameter roll 570*a* and the second different diameter roll 570*b* in the intersecting direction (x direction) while maintaining a state where the first large diameter portion 573 and the second large diameter portion 577 face each other in the period illustrated in FIG. 9D described above, that is, when the sheet bundle B is pulled back by the first folding roll 36 and the sheet bundle B is separated from the second folding roll 570. Specifically, for example, the first different diameter roll 570*a* and the second different diameter roll 570*b* are moved from the position 51 to the position S2. Therefore, when the sheet bundle B passes through the second folding roll 570 again, the position of the contact portion Bd formed in the sheet bundle B is moved. Furthermore, a state where the contact portion Bd formed on one surface of the sheet bundle B is positioned in the same position as the contact portion Bd formed on the other surface in the intersecting direction (x direction) is maintained.

The first large diameter portion 573 and the second large diameter portion 577 are different from the first nip portion 373 and the second nip portion 377 (see FIG. 5), and a position of a portion contacting with the sheet bundle B in the intersecting direction (x direction) is not moved as the first rotating shaft 571 and the second rotating shaft 575 are rotated. In other words, a force from the sheet bundle B in the intersecting direction (x direction) is not received. Therefore, the first large diameter portion 573 and the second large diameter portion 577 are protected from being peeled from the first rotating shaft 571 and the second rotating shaft 575.

Moreover, differently from the above description, for example, a contacting-separating mechanism (not illustrated) that contacts and separates one of the first different diameter roll 570*a* and the second different diameter roll 570*b* with and from the other is provided and the moving mechanism 91 may move the first different diameter roll 570*a* and the second different diameter roll 570*b* in the intersecting direction (x direction), when the contacting-separating mechanism separates the first different diameter roll 570*a* and the second different diameter roll 570*b* from each other.

In other words, in the configuration, the sheet bundle B may be pulled back by the first folding roll 36 or may not be pulled back by the first folding roll 36. In the latter case, by the contacting-separating mechanism, the first different diameter roll 570*a* and the second different diameter roll 570*b* are separated while stopping the sheet bundle B, and then the first different diameter roll 570*a* and the second different diameter roll 570*b* are moved in the intersecting direction (x direction) by the moving mechanism 91, and the first different diameter roll 570*a* and the second different diameter roll 570*b* approach each other again. Therefore, the position of the contact portion Bd formed in the sheet bundle B is moved without moving the sheet bundle B.

Furthermore, it is not essential that the first different diameter roll 570*a* and the second different diameter roll 570*b* include plural first large diameter portions 573 and second large diameter portions 577, and may include one, respectively.

Otherwise, it is not essential that the first large diameter portions 573 and the second large diameter portions 577 be provided at a predetermined gap (distance L9), and for example, may be formed in a different pitch, for example, the center portion may be densely provided than the end portion in the intersecting direction (x direction).

Furthermore, one of the first different diameter roll 570*a* and the second different diameter roll 570*b* may be configured of a roll (not illustrated) of which an outer diameter is not changed along the intersecting direction (x direction), that is, may be formed of a substantially columnar roll.

MODIFICATION EXAMPLE

Next, a modification example of each exemplary embodiment described above will be described.

FIGS. 15A to 15F are schematic configuration views of the modification example of a first spiral roll 37*a*. FIGS. 16A and 16B are schematic configuration views of the modification example of a first nip portion 373.

In the description regarding FIG. 5 described above, it is described that the first spiral roll 37*a* (and the second spiral roll 37*b*) is provided with the first nip portion 373 spirally attached to the outer periphery of the first rotating shaft 371. However, the first spiral roll 37*a* (and the second spiral roll 37*b*) is not limited to such a configuration and may be configured such that the first nip portion 373 presses a part of the sheet bundle B in the intersecting direction (x direction) and the position of the contact portion Bd in the sheet bundle B is changed in the intersecting direction (x direction) as the rotation angle (phase) in the first rotating shaft 371 is changed.

Figure 15A:
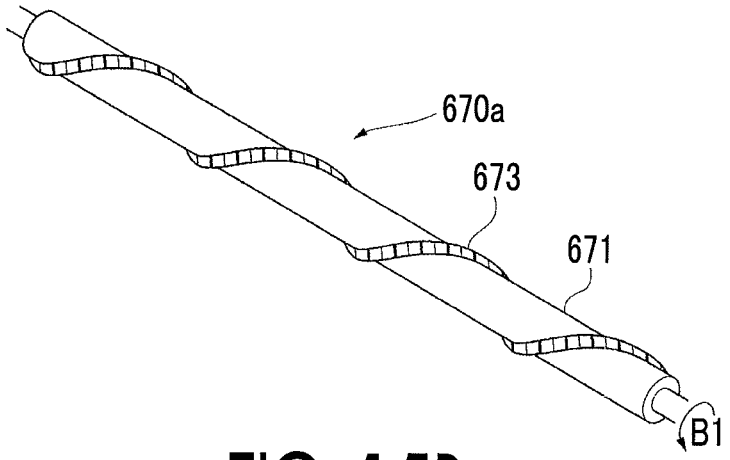
FIGS. 15A to 15F are schematic configuration views of a modification example of a first spiral roll.
Figure 16A:
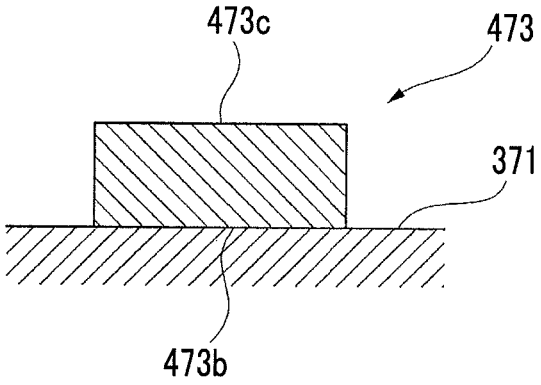
FIGS. 16A and 16B are schematic configuration views of a modification example of a first nip portion.
Figure 16B:
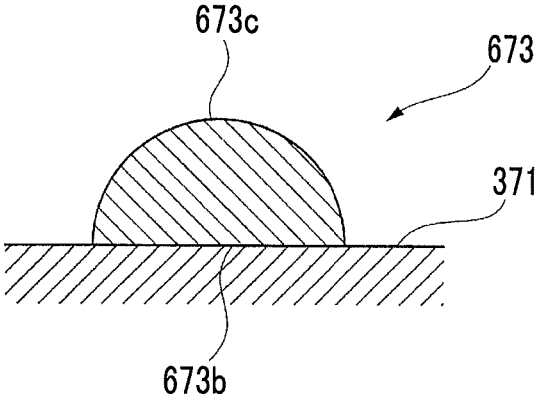

For example, as a first spiral roll 670*a* illustrated in FIG. 15A, a first rotating shaft 671 and a spiral first nip portion 673 that is wound in one direction on an outer periphery of the first rotating shaft 671 may be configured.

Figure 15B:
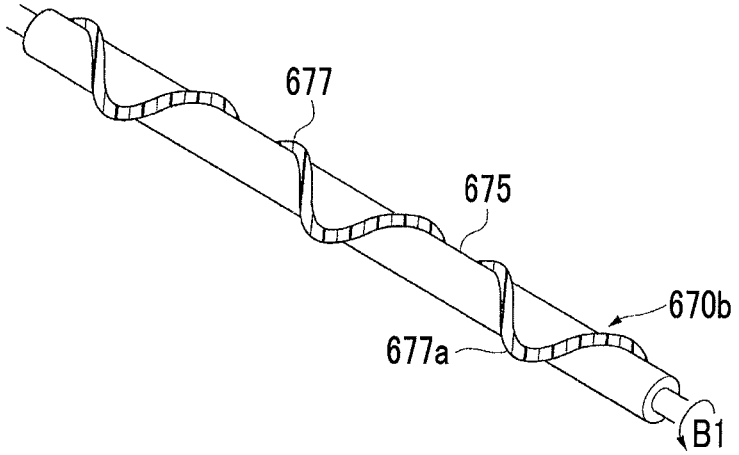

Furthermore, as a first spiral roll 670*b* illustrated in FIG. 15B, a first rotating shaft 675 and plural first nip portions 677 that are v-shaped members provided on an outer periphery of the first rotating shaft 675 may be configured in the intersecting direction (x direction). The v-shaped first nip portion 677 is moved so that a closed end portion 677*a* in the v-shape on the first nip portion 677 is the leading end as the first nip portion 677 is rotated forward (see arrow B1 in the view).

Figure 15C:
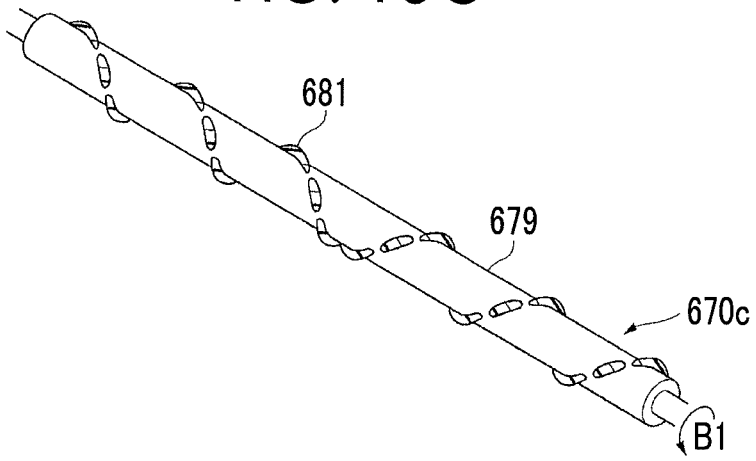

Furthermore, as a first spiral roll 670*c* illustrated in FIG. 15C, plural protrusion portions 681 which are discontinuously formed along two spirals having different directions from each other with respect to a center portion of the first rotating shaft 679 in the axial direction may be configured on the outer peripheral surface of the first rotating shaft 679.

Figure 15D:
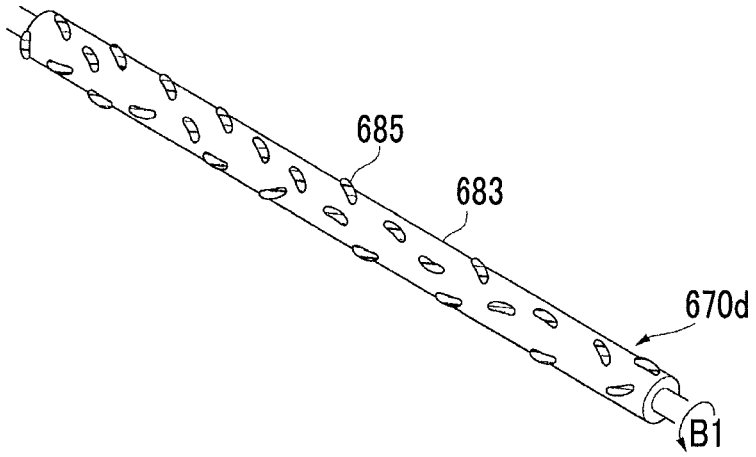

Furthermore, as a first spiral roll 670*d* illustrated in FIG. 15D, a first rotating shaft 683 and plural protrusion portions 685 of which positions are irregularly formed on an outer periphery of a first rotating shaft 683 may be configured.

Figure 15E:
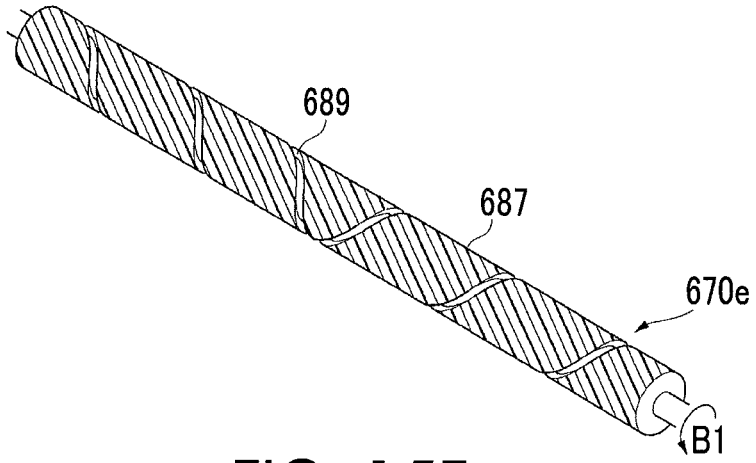

Otherwise, as a first spiral roll 670*e* illustrated in FIG. 15E, a first rotating shaft 687 and a spiral groove 689 formed on an outer periphery of the first rotating shaft 687 may be configured.

Figure 15F:
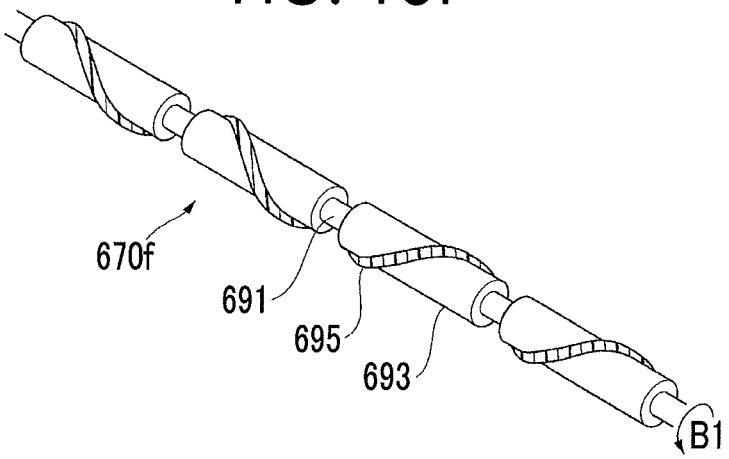

Furthermore, as a first spiral roll 670*f* illustrated in FIG. 15F, a first rotating shaft 691, plural large diameter portions 693 provided on an outer periphery of the first rotating shaft 691, and a first nip portion 695 spirally provided on an outer periphery of the large diameter portion 693 may be configured. Moreover, in the first spiral roll 670*f*, a space (groove) for inserting the leading end of the knife body 35*a* (see FIG. 4) is formed between the large diameter portions 693 in the intersecting direction (x direction), and for example, the first spiral roll 670*f* may be provided instead of the first folding roll 36 (see FIG. 4).

Furthermore, it is described that the first nip portion 373 illustrated in FIG. 6C described above has a substantially trapezoidal cross section, but the invention is not limited to such a configuration. For example, as illustrated in FIG. 16A, a first nip portion 473 may be a substantially rectangular shape in cross section in which widths of a base portion 473*b* and a top portion 473*c* are substantially the same as each other. Otherwise, as illustrated in FIG. 16B, a first nip portion 673 may have a cross section of a substantially semi-circular shape (bowl shape) in which a base portion 673*b* is a flat surface and a top portion 673*c* is a curved convex surface.

Moreover, the configuration described with reference to FIGS. 15A to 15F, and FIGS. 16A and 16B described above is related to the first spiral roll 37*a*, but the same configuration may be applied to the second spiral roll 37*b*.

Meanwhile, in the above exemplary embodiments, it is described that the position of the contact portion Bd in the sheet bundle B is changed by changing the rotation angle of the second folding roll 37 or the position in the intersecting direction (x direction). Meanwhile, the position of the contact portion Bd in the sheet bundle B may be changed by moving the sheet bundle B in the intersecting direction (x direction) instead of adjusting the rotation angle or the position of the second folding roll 37 or in addition to the adjustment thereof. When further describing, the pulled back sheet B may be moved in the intersecting direction (x direction) after the period illustrated in FIG. 9D described above, that is, after the sheet bundle B is pulled back by the first folding roll 36 and the sheet bundle B is separated from the second folding roll 37. The sheet bundle B may be moved in the intersecting direction (x direction), for example, by driving the first folding roll 36 that pulls back the sheet bundle B by a drive source (not illustrated) which is not the first motor M1 and the movement of the sheet bundle B is realized by moving the first folding roll 36 by the drive source when the first folding roll 36 pulls back the sheet bundle B.

Otherwise, the first folding roll 36 and the second folding roll 37 may be configured to be separately driven differently from in the above description with reference to FIGS. 7A and 7B. In the configuration, for example, when the sheet bundle B is pulled back, the first folding roll 36 and the second folding roll 37 are driven and the sheet bundle B is separated from the second folding roll 37, and then the phases of the first folding roll 36 and the second folding roll 37 are deviated, and, for example, the rotation of the second folding roll 37 may be stopped while the first folding roll 36 continues to rotate in the direction in which the first folding roll 36 pulls back the sheet bundle B. Otherwise, for example, after the sheet bundle B is separated from the second folding roll 37, the first folding roll 36 is stopped and the second folding roll 37 may be rotated.

Otherwise, the sheet bundle B is configured not to be reciprocated and a branch path that is branched from the sheet transport path on the downstream side other than the second folding roll 37 and is connected to the sheet transport path on the upstream side other than the second folding roll 37 may be formed differently from in the above description with reference to FIGS. 9A to 9F. Then, the folding process may be performed by transporting one sheet bundle B to the second folding roll 37 through the branch path plural times. Moreover, as described above, in the configuration in which the sheet bundle B is reciprocated, since the branch path is not necessary, dimensions necessary for transporting the sheet bundle B on the upstream side than the second folding roll 37 are reduced.

Furthermore, the above exemplary embodiments may be applied to the folding function portion 50 (see FIG. 2) that performs the folding of inwardly three-folding (C folding), outwardly three-folding (Z folding), or the like with respect to the sheet S. Furthermore, the second folding roll 37 may be provided instead of the first folding roll 36 or the discharge roll 38 illustrated in FIG. 3. When further describing, in the above exemplary embodiments, it is described that the folding process is performed in the sheet bundle B, but the folding process may be performed in one sheet S.

Moreover, the configuration in which the binding process is performed in the sheet bundle B by the stapler 82 is not essential and the above exemplary embodiments may be applied to the sheet bundle B in which the binding process is not performed by the stapler 82.

Moreover, the second folding roll 37 and the drive portion 81 together are an example of the sheet folding device.

The one-way clutch 851*a* is an example of the phase change unit.

The first folding roll 36 is an example of the transport portion.

The first nip portion 373 is an example of the first convex portion and the first spiral roll 37*a* is an example of the first roll. The second nip portion 377 is an example of the second convex portion and the second spiral roll 37*b* is an example of the second roll.

The drive portion 81 is an example of the rotating mechanism.

The compile tray 31 is an example of the stack portion.

The image forming portion 10 is an example of the image forming unit.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet folding device comprising:

a folding roll that has a convex portion spirally provided on an outer periphery surface and is rotatably provided, and performs a folding process on a sheet while pressing a pressing portion of the convex portion on the sheet;

a phase change unit that changes from a first phase of the folding roll during which the sheet on which the folding process is performed by the folding roll passes through the folding roll a first time to a second phase during which the sheet passes through the folding roll for a second time, such that a first pressed position on the sheet by the convex portion in the first phase is different from a second pressed position on the sheet by the convex portion in the second phase;

a transport portion that transports the sheet to the folding roll the second time after the sheet on which the folding process is performed by the folding roll is pulled back to an upstream side from the folding roll in a transporting direction; and a drive portion that supplies a driving force of the folding roll and the transport portion, wherein the transport portion rotates in one direction while receiving drive by the drive portion and rotates in a direction opposite to the one direction while receiving the drive by the drive portion after pulling back the sheet on which the folding process is performed by the folding roll on the upstream side in the transporting direction, and transports the sheet to the folding roll, and wherein the phase change unit does not transmit the drive from the drive portion to the folding roll when the drive portion rotates the transport portion in the one direction, and transmits the drive from the drive portion to the folding roll when the drive portion rotates the transport portion in the opposite direction.

2. The sheet folding device according to claim 1, wherein the folding roll includes:

a first roll that has a first convex portion spirally provided on an outer peripheral surface;

a second roll that is provided along the first roll and has a second convex portion spirally provided in a position facing the first convex portion of the first roll on an outer peripheral surface; and a rotating mechanism that rotates the first roll and the second roll, and performs the folding process on the sheet while interposing the sheet between the first convex portion of the first roll and the second convex portion of the second roll.

3. The sheet folding device according to claim 1, wherein the folding roll includes:

a first roll that has a first convex portion spirally provided on an outer peripheral surface;

a second roll that is provided along the first roll and has a second convex portion spirally provided in a position facing the first convex portion of the first roll on an outer peripheral surface; and a rotating mechanism that rotates the first roll and the second roll, and performs the folding process on the sheet while interposing the sheet between the first convex portion of the first roll and the second convex portion of the second roll.

4. The sheet folding device according to claim 1, wherein the folding roll includes:

a first roll that has a first convex portion spirally provided on an outer peripheral surface;

a second roll that is provided along the first roll and has a second convex portion spirally provided in a position facing the first convex portion of the first roll on an outer peripheral surface; and a rotating mechanism that rotates the first roll and the second roll, and performs the folding process on the sheet while interposing the sheet between the first convex portion of the first roll and the second convex portion of the second roll.

5. The sheet folding device according to claim 1, wherein the first pressed position on the sheet by the convex portion is not overlapped with the second pressed position on the sheet by the convex portion.

6. A post-processing device comprising:

a stack portion that stacks a sheet and forms a sheet bundle;

a folding roll that has a convex portion spirally provided on an outer peripheral surface and is rotatably provided, and performs a folding process while pressing the convex portion on the sheet bundle formed in the stack portion; and a phase change unit that changes from a first phase of the folding roll during which the sheet bundle on which the folding process is performed by the folding roll passes through the folding roll a first time to a second phase during which the sheet bundle passes through the folding roll for a second time, such that a first pressed position on the sheet by the convex portion in the first phase is different from a second pressed position on the sheet by the convex portion in the second phase;

a transport portion that transports the sheet to the folding roll the second time after the sheet on which the folding process is performed by the folding roll is pulled back to an upstream side from the folding roll in a transporting direction; and a drive portion that supplies a driving force of the folding roll and the transport portion, wherein the transport portion rotates in one direction while receiving drive by the drive portion and rotates in a direction opposite to the one direction while receiving the drive by the drive portion after pulling back the sheet on which the folding process is performed by the folding roll on the upstream side in the transporting direction, and transports the sheet to the folding roll, and wherein the phase change unit does not transmit the drive from the drive portion to the folding roll when the drive portion rotates the transport portion in the one direction, and transmits the drive from the drive portion to the folding roll when the drive portion rotates the transport portion in the opposite direction.

7. An image forming system comprising:

an image forming unit that forms an image on a sheet;

a folding roll that has a convex portion spirally provided on an outer peripheral surface and is rotatably provided, and performs a folding process while pressing the convex portion on the sheet on which the image is formed by the image forming unit; and a phase change unit that changes from a first phase of the folding roll during which the sheet on which the folding process is performed by the folding roll passes through the folding roll a first time to a second phase during which the sheet passes through the folding roll for a second time, such that a first pressed position on the sheet by the convex portion in the first phase is different from a second pressed position on the sheet by the convex portion in the second phase;

a transport portion that transports the sheet to the folding roll the second time after the sheet on which the folding process is performed by the folding roll is pulled back to an upstream side from the folding roll in a transporting direction; and a drive portion that supplies a driving force of the folding roll and the transport portion, wherein the transport portion rotates in one direction while receiving drive by the drive portion and rotates in a direction opposite to the one direction while receiving the drive by the drive portion after pulling back the sheet on which the folding process is performed by the folding roll on the upstream side in the transporting direction, and transports the sheet to the folding roll, and wherein the phase change unit does not transmit the drive from the drive portion to the folding roll when the drive portion rotates the transport portion in the one direction, and transmits the drive from the drive portion to the folding roll when the drive portion rotates the transport portion in the opposite direction.

* * * * *